US006364449B1

(12) United States Patent
Takahashi et al.

(10) Patent No.: US 6,364,449 B1
(45) Date of Patent: Apr. 2, 2002

(54) INK JET RECORDING APPARATUS AND CLEANING CONTROL METHOD FOR THE SAME

(75) Inventors: Nobuhito Takahashi; Kazuhiko Hara; Yukihiro Uchiyama, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/395,990

(22) Filed: Sep. 15, 1999

(30) Foreign Application Priority Data

| | | |
|---|---|---|
| Sep. 16, 1998 | (JP) | 10-262123 |
| Aug. 2, 1999 | (JP) | 11-218947 |
| Aug. 9, 1999 | (JP) | 11-225511 |

(51) Int. Cl.[7] ..... B41J 2/165
(52) U.S. Cl. ..... 347/30; 347/29; 347/36
(58) Field of Search ..... 347/30, 29, 32, 347/23, 86, 24, 36

(56) References Cited

U.S. PATENT DOCUMENTS

| | | | | |
|---|---|---|---|---|
| 4,965,596 A | * | 10/1990 | Nagoshi et al. | 347/36 |
| 5,113,206 A | * | 5/1992 | Fukazawa | 347/36 |
| 5,172,140 A | * | 12/1992 | Hirayabashi et al. | 347/36 |
| 5,625,385 A | | 4/1997 | Suzuki | 347/24 |
| 5,798,775 A | * | 8/1998 | Takahashi et al. | 347/33 |
| 5,898,444 A | * | 4/1999 | Kobayashi et al. | 347/29 |
| 5,903,287 A | * | 5/1999 | Ishikawa et al. | 347/24 |
| 5,988,788 A | * | 11/1999 | Suzuki et al. | 347/30 |
| 6,227,642 B1 | * | 5/2001 | Hanabusa et al. | 347/195.113 |

FOREIGN PATENT DOCUMENTS

| | | | | |
|---|---|---|---|---|
| EP | 0 562 118 A1 | | 9/1993 | |
| EP | 0 585 923 | | 3/1994 | B41J/2/165 |
| EP | 0 585 923 A2 | | 3/1994 | |
| EP | 0 630 754 A2 | | 12/1994 | |
| EP | 0 744 294 | * | 11/1996 | |
| EP | 0 785 084 | | 7/1997 | B41J/23/02 |
| EP | 0 785 084 A2 | | 7/1997 | |
| EP | 0 819 541 A2 | | 1/1998 | |
| EP | 0 850 765 A2 | | 7/1998 | |
| EP | 0 850 765 | | 7/1998 | B41J/2/165 |
| EP | 0 867 296 A2 | | 9/1998 | |
| GB | 2 284 576 | | 6/1995 | B41J/2/165 |
| JP | 01281947 | * | 11/1989 | |

OTHER PUBLICATIONS

European Search Report dated Feb. 14, 2001 00124651.1–2304–, Widmeier, W.
European Search Report dated Feb. 15, 2001 00124647.9–2304–, Widmeier, W.
Communication from a Foreign Patent Office, EP 99 11 8384, Mar. 10, 2000 Widmeier, W.

* cited by examiner

*Primary Examiner*—N. Le
*Assistant Examiner*—Shih-Wen Hsieh
(74) *Attorney, Agent, or Firm*—Sughrue Mion, PLLC

(57) ABSTRACT

An ink jet recording apparatus comprises: at least one recording head having a face on which a plurality of nozzle orifices are formed, the recording head mounted on a carriage to be moved reciprocatively in the widthwise direction of a recording sheet; a capping device disposed in a non-print region of the recording head, the capping device including at least one cap unit for sealing the nozzle-formed surface of the recording head in cooperation with the movement of carriage; and a plurality of suction pumps for applying negative pressure in the interior space of the cap unit via suction tubes while the cap unit seals the nozzle-formed surface in cooperation with at least one drive source. The number of the suction pumps is at least equal to the number of the cap unit.

72 Claims, 24 Drawing Sheets

INK JET RECORDING APPARATUS AND CLEANING CONTROL METHOD FOR THE SAME

BACKGROUND OF THE INVENTION

The present invention relates to an ink jet recording apparatus comprising a carriage which travels in a widthwise direction of a recording sheet or the like; and a recording head mounted on the carriage for jetting ink droplets to record an image on the recording sheet in accordance with print data. Particularly, the present invention relates to a cleaning control technique which shortens a suction time required for maintenance of the recording head or for refilling the recording head with ink, and promotes removal of ink, whose viscosity has been increased, and air bubbles from an ink channel extending from an ink reservoir to the recording head.

Since owing to the development of personal computers graphic processing can be performed relatively easily, a demand exists for recording apparatuses that can, for example, output high quality hard copies of color images displayed on screens. In response to this demand, recording apparatuses in which ink jet recording heads are mounted are being produced. Since during printing the noise made by such ink jet recording apparatuses is relatively low, and since the apparatuses can deposit small dots at a high density, the apparatuses are presently being used to perform a variety of different types of printing, to include color printing.

Such an ink jet recording apparatus comprises: ink jet recording heads, for receiving ink from ink cartridges; and a paper feeding mechanism, for moving a recording sheet relative to the recording head. During the printing process, the recording heads, which are carried along by a carriage while it moves the width of a recording sheet, eject ink droplets that are deposited on the recording sheet. Mounted on the common carriage are a black recording head for ejecting black ink, and color recording heads for ejecting yellow, cyan and magenta inks, for example, so that not only can text be printed in black ink, but also full color printing can be performed by changing the ratio of the inks to be ejected.

Since the ink jet recording heads perform printing by pressurizing ink in a pressure generating chamber and then ejecting that ink through nozzles as ink droplets, a print failure can be caused by an increase in the viscosity of the ink or the solidification of the ink due to the evaporation of a solvent through nozzle orifices, by the attachment of dust particles, or by the entry of air bubbles.

Therefore, the ink jet recording apparatus further comprises a cap for sealing the nozzle orifices of the recording head while printing is not being performed, and a wiping blade for cleaning a nozzle plate as needed. The cap not only serves as a lid for protecting ink at the nozzle orifices from being dried out when printing is not being performed, but when the nozzle orifices are clogged, it also seals a nozzle plate and induces a flow of ink through the nozzle orifices so as to resolve an ink ejection failure that is caused by the clogging of the nozzle orifices due to the solidification of ink, or due to air bubbles that have entered an ink channel.

The forcible ink suction process, which is performed to prevent the clogging of the recording head or the entry of air bubbles into an ink channel, is normally called a cleaning operation. The cleaning operation is begun when printing is restarted after the apparatus has been halted for a long time, or when a user manipulates a cleaning switch to resolve the degrading of the quality of a recorded image. For this process, ink droplets are drawn out through the nozzle orifices by the application of a negative pressure, and the wiping blade, constituted by an elastic rubber plate, wipes the surface of the recording head.

The capping member also has a capability of discharging ink droplets by application to the recording head of a drive signal that is irrelevant to printing. This function is called a flushing operation. The flushing operation is performed at predetermined cycles for the purposes of: recovering meniscuses, which are irregularly formed in the vicinity of nozzle orifices of the recording head as a result of wiping action of the wiping blade during the cleaning operation; preventing mixture of colors, which would be removed by the capping member applying weak suction to the ink at the nozzle orifices; and preventing clogging in the nozzle orifices from which a small amount of ink droplets is ejected during a printing operation, which would otherwise be caused by an increase in the viscosity of ink.

There has recently been provided an ink jet recording apparatus which uses at least six colors of ink; that is, dark magenta, light magenta, dark cyan, light cyan, yellow, and black, in order to improve the quality of a print at the time of color printing.

The ink jet recording apparatus that uses multiple colors of ink requires at least six rows of nozzle orifices. In order to improve yield in the manufacturing processes and to simplify the sealing effected by the capping member, two recording heads are usually mounted on one carriage. Further, the capping member is provided with cap units for individually sealing the respective recording heads and two suction pumps for applying negative pressure to the respective cap units. The two suction pumps are connected to a paper feed motor by way of a joint mechanism which is brought into or out of contact with a paper feed mechanism according to the position of the carriage.

Although such a configuration enables a reduction in load imposed on the motor at the time of actuation of the pump, it disadvantageously requires much time for maintenance of the recording head or a built-in mechanism provided in the pumps for selecting between the two pumps according to the direction of rotation, which in turn results in complication of the structure of the pumps or renders the pumps bulky.

In order to greatly improve the resolution of an image recorded on the recording sheet, the number of nozzle orifices formed on each recording head tends to be increased more and more, or the diameter of the nozzle orifices tends to be reduced further. In the configuration of the ink jet recording apparatus, in which the individual recording heads are alternately sucked by means of a single suction pump, a deficiency arises in the suction capability of the pump.

For example, air bubbles, which have entered the ink channel in association with replacement of an ink cartridge, go on to enter the recording head, thereby resulting in ink ejecting failures.

In order to prevent the ink ejecting failures, the air bubbles are discharged from the inside of the recording head (i.e., a replacement cleaning operation is performed) simultaneous with suction and discharge of ink from the recording head. In a case where the flow rate of ink is lower than a predetermined flow rate as a result of a deficiency arising in the suction capability of the pumps, air bubbles present in the recording head remain caught within a complicated flow channel within the recording head. The replacement cleaning operation may result in mere consumption of ink but never ends in elimination of the air bubbles. For this reason, a flow rate faster than the predetermined flow rate must be achieved in order to sufficiently discharge the ink, whose viscosity has been increased, and air bubbles from the inside of the recording head. To this end, the suction capability of the pump must be increased greatly.

This type of recording apparatus generally employs, as a suction pump, a tube pump which generates negative pressure by sequentially squeezing a tube arranged in a circular-arch pattern through use of a roller, for the purpose of implementing an inexpensive suction pump, ensuring the operation of the suction pump, and preventing ink stains.

A conceivable measure to improve the suction capability of such a tube pump is to increase the number of rotations of the pump, as well as to increase the radius of the tube arranged in the circular-arch pattern.

However, if the number of rotations of the pump is increased, the number of times the tube is squeezed by the roller is increased, thus shortening the life of the pump. In contrast, if the radius of the tube arranged in the circular-arch pattern is increased, the outer diameter of the pump is inevitably increased. In this type of recording apparatus intended to be made compact, an extreme difficulty is encountered in determining the layout of such a pump, and therefore the designer encounters great difficulty in designing a product.

Generation of the fastest possible flow of ink within the ink channel between the ink reservoir; e.g., an ink cartridge, and nozzle orifices of the recording head is an effective measure for performing the previously-described cleaning operation. The fastest flow enables discharge of the air bubbles present within the flow channel to a certain extent together with removal of ink whose viscosity has been increased. Simultaneously, ink solids adhering to the vicinity of the nozzle orifices can also be removed. However, increasing the flow rate of ink during the cleaning operation requires an increase in the suction capability of the tube pump for the purpose of generating large negative pressure. This involves the problems such as those mentioned previously.

In order to generate a fast flow of ink, there is proposed a recording apparatus comprising a valve member disposed within an ink channel between the ink cartridge and the recording head for opening/closing the channel. When suction of ink is initiated by way of the capping member at the time of a cleaning operation, the valve member is closed. After negative pressure has been accumulated within an internal space of the capping member as a result of actuation of a suction pump, the valve member is opened to instantaneously increase the flow rate of ink within the recording head.

By means of this configuration, ink is instantaneously discharged with momentum to the inside of the capping member by the action of the accumulated negative pressure, thereby enabling discharge of air bubbles present in the channel, along with ink whose viscosity has been increased.

Since the valve member is opened while the suction pump remains idle, the ink discharged to the inside of the capping member remains frothed. The bubbles of ink adhere to the nozzle formation plane of the recording head and re-enter the nozzle orifices. This phenomenon results in a failure in the normal ejecting of ink droplets from the nozzle orifices, as well as printing of an image in mixed colors as a result of mixing of black ink and three color inks. In order to prevent the failures, there must be performed many repetitions of flushing operation, re-suction of ink while the negative pressure is reduced, and wiping operation.

Even when an attempt is made to forcibly remove ink clogging the nozzle orifices by means of only the accumulated negative pressure, the ink may not be readily removed if the adhesion of the ink to the nozzle orifices is relatively strong. The technical solution for increasing the suction capability of the pump is again sought, which in turn entails an increase in the size of the pump and the recording apparatus, as mentioned previously. Thus, means for solving the problems simultaneously is sought.

SUMMARY OF THE INVENTION

The present invention has been conceived in view of the technical problems described previously, and the first object of the present invention is to provide an ink jet recording apparatus capable of shortening suction time required for maintenance of a recording head and replenishment of ink, improving the suction capability of a pump unit, simplifying the pump unit, and being made compact overall.

The second object of the present is to provide a cleaning control method suitable for use with an ink jet recording apparatus having two recording heads.

The third object of the present invention is to provide an ink jet recording apparatus which eliminates clogging in a recording head and promotes discharge of air bubbles present in an ink channel without involvement of an increase in the size of the apparatus, as well as to provide a cleaning control method for use with the ink jet recording apparatus.

In order to achieve the first object, there is provided an ink jet recording apparatus comprising: at least one recording head having a face on which a plurality of nozzle orifices are formed, the recording head mounted on a carriage to be moved reciprocatively in the widthwise direction of a recording sheet; a capping device disposed in a non-print region of the recording head, the capping device including at least one cap unit for sealing the nozzle-formed surface of the recording head in cooperation with the movement of carriage; and a plurality of suction pumps for applying negative pressure in the interior space of the cap unit via suction tubes while the cap unit seals the nozzle-formed surface in cooperation with at least one drive source. The number of the suction pumps is at least equal to the number of the cap unit.

The apparatus may be configured that: a first recording head and a second recording head is mounted on the carriage; the capping device includes a first cap unit and a second cap unit provided for the first recording head and the second recording head respectively; and the plural suction pumps include a first suction pump and a second suction pump for applying negative pressure with respect to the first and second cap units respectively.

The respective suction pumps may cooperate with a single drive source.

The suction tubes may include a first suction tube for connecting the first cap unit and the first suction pump and a second suction pump for connecting the second cap unit and the second suction pumps which are different from each other in length or inner diameter.

The apparatus may be configured that: the cap unit includes a plurality of suction ports respectively communicating with the interior space thereof and connected to the respective suction pumps via the suction tubes; and the respective suction pumps perform the suction operation simultaneously.

The suction ports may be formed on an inner bottom portion of the cap unit and at one end portion in the longitudinal direction thereof. The suction ports may be arranged closely to one another. An air hole may be formed on an inner bottom portion of the cap unit and at the other end portion in the longitudinal direction thereof.

There may be provided in at least one of the suction tubes a valve member for opening/closing the same or a variable flow resistor for varying flow resistance thereof.

The apparatus may be configured that: the capping device includes a plurality of cap units; each of the cap units includes a suction port communicating with the respective interior space thereof; and each of the suction tubes connected to the respective suction ports has a junction portion for combining tubes connected to the respective suction pumps which perform the suction operation simultaneously.

The apparatus may be configured that: the capping device includes a plurality of cap units; each of the cap units includes a suction port communicating with the respective interior space thereof; and the suction tubes includes a first junction portion for combining subtubes connected to the respective suction ports and a second junction portion connected to the first junction portion for combining subtubes connected to the respective suction pumps which perform the suction operation simultaneously.

The subtubes connected to the respective suction pumps may be substantially the same in length. If necessary, the subtubes connected to the respective suction pumps may be different from each other in length or inner diameter. The subtubes connected to the respective suction ports may be different from each other in length or inner diameter.

There may be provided in at least one of the subtubes connected to the respective suction pumps a valve member for opening/closing the same or a variable flow resistor for varying flow resistance thereof.

The subtubes connected to the respective suction ports and the tubes connected to the respective suction pumps may be made of different materials.

The subtubes connected to the respective suction ports may be made of a material having high gas-barrier characteristic.

The recording head, which is sealed by the cap unit having shorter or thicker suction tube, may have larger number of the nozzle orifices.

The recording head for ejecting ink most susceptible to an increase in viscosity may be sealed by the cap unit having shorter or thicker suction tube.

There may be provided in at least one of the subtubes connected to the respective suction ports a valve member for opening/closing the same or a variable flow resistor for varying flow resistance thereof.

The subtube in which the valve member or the variable flow resistor is provided may be connected to a cap unit for sealing a recording head having relatively smaller number of nozzle orifices or a recording head for ejecting ink most susceptible to an increase in viscosity.

Each of the suction pumps may include: a frame body having a semicircular support face for supporting one of the suction tubes therealong; a wheel body rotated by the drive source in the frame body; and a plurality of rollers rotatably provided on the wheel body for squeezing the suction tube supported on the support surface. The rollers squeeze the suction tubes so as to become out of phase in the rotation direction of the wheel body with one another from the suction pump to the suction pump.

The plural suction pumps may be composed of a first suction pump and a second suction pump. The frame bodies of the first and second suction pumps are attached with each other so as to the central axis of the wheel bodies are made coincident with each other. The rollers squeeze the suction tubes so as to be 90° out of phase in the rotation direction of the wheel body with one another from the first suction pump to the second suction pump. Outlets of the plural suction pumps may be lead to different waste-ink tanks.

The apparatus may further comprise means for counting the amount of ink flowing into the waste-ink tanks.

The counting means may count accumulately the amount of ink by selectively use of parameters specified according to respective ink suction operation modes.

The apparatus may further comprise: means for indicating whether the amount of ink counted by the counting means reaches for a predetermined value; and means for deactivating the apparatus when the amount of ink counted by the counting means reaches for a predetermined value.

Waste fluid absorbing members disposed in the respective waste-ink tanks are substantially the same in size. If necessary, the fluid absorbing members may be different from each other in size.

The counting means may be provided for each of the waste-ink tanks.

In order to achieve the second object, there is provided a cleaning control method for use with an ink jet recording apparatus comprising an elastic wiping blade abutted against the nozzle-formed faces of the first and second recording heads for wiping away ink adhering thereto, the method comprises the steps of: moving the carriage so the wiping blade as to wipe away ink adhering to the nozzle-formed face of the first recording head; stopping the carriage at a position where the wiping blade is situated between the first and second recording heads; waiting for the wiping blade to elastically restore to the original state thereof; and moving the carriage so the wiping blade as to wipe away ink adhering to the nozzle-formed face of the second recording head.

In order to achieve the second object without adopting the above method, the above apparatus discussed with regard to the first object may further comprise: an elastic wiping blade abutted against the nozzle-formed faces of the first and second recording heads for wiping away ink adhering thereto; and a spacer disposed between the first and second recording head so as to be touched by the wiping blade. The spacer may be made of a water-absorbing material. The apparatus may further comprise an absorber made of a water-absorbing material, and disposed between the first and second cap units so as to be brought into contact with the spacer while the nozzle-formed faces of the first and second recording heads are sealed by the first and second cap units.

In the ink jet recording apparatus employing the foregoing cleaning control method, the interior space of the cap units is evacuated by means of a plurality of suction pumps which simultaneously perform suction operation. As a result, the suction capability of the recording heads can be improved, and the ink, which is stored in the recording heads and whose viscosity has been increased, and air bubbles can be efficiently discharged. Accordingly, high-grade print quality of the recording apparatus can be ensured.

In this case, a tube pump which squeezes a tube by means of nipping action of a roller is used as the suction pump. As a result, the suction pumps can be connected by linearly connecting the drive shafts of the tube pumps in tandem, thereby reducing the volume occupied by the plurality of pumps.

Thus, the recording apparatus can be made compact as a whole. Further, the loads exerted on the pumps can be averaged by arranging the pumps such that the rollers squeeze the tubes such that the rollers come out of phase with one another from pump to pump in the direction of rotation of the pump wheel. Consequently, a motor having a large output rating is not required to be used as a drive source. This also contributes to a reduction in the size of the overall recording apparatus.

Valve member capable of opening or closing a suction channel, as needed, or a variable flow register capable of changing the resistance of the suction channel is disposed in the suction channels connected to the plurality of suction pumps. In a suction mode which does not require evacuation of a large amount of ink from the recording head, the amount of ink to be discharged can be controlled. As a result, the amount of ink supplied to the waste-ink tank can be reduced, thereby extending the interval for maintenance of the waste-ink tank and resulting in a reduction in consumption of the ink stored in an ink cartridge.

Further, so long as the recording apparatus is provided with means for counting the amount of ink supplied to the waste-ink tank, and an indication is made when the count made by the counting means exceeds a preset threshold value, an overflow of ink from the waste-ink tank can be prevented, thereby urging the user to perform maintenance of the waste-ink tank.

In order to achieve the third object, the above apparatus may further comprise: an ink reservoir for supplying ink to the recording head via a channel; a valve member provided in the channel, the valve member opened when the negative pressure is sufficiently accumulated within the interior space of the cap unit; at least two suction ports formed on the cap unit so as to be spaced apart from each other and connected to the respective suction pumps via the suction tubes; and control means for opening/closing the valve member and for driving the suction pumps either selectively or simultaneously.

The suction ports may be formed on a bottom face of the cap unit so as to be situated at both ends of a row of nozzle orifices for jetting ink most susceptible to an increase in viscosity while the nozzle-formed face of the recording head is sealed by the cap unit.

According to the present invention, there is also adopted a cleaning control method for use of the above apparatus, comprising the steps of: opening the valve member; driving the suction pumps simultaneously; closing the valve member; driving the suction pumps selectively; driving the suction pumps simultaneously; and opening the valve member. The order of the simultaneous drive and the selective drive while the valve member is opened may be interchanged.

The suction operation of the suction pumps may be continued for a predetermined time period even after the final step of opening the valve members.

The apparatus may comprise a plurality of ink reservoirs, channels and valve members.

According to the present invention, there is also adopted a cleaning control method for use of the above apparatus, comprising the steps of: opening the valve members; driving the suction pumps simultaneously; closing valve members other than a valve member for a row of nozzle orifices for ejecting ink most susceptible to an increase in viscosity; driving the suction pumps simultaneously; driving the suction pumps selectively; and opening the closed valve members. The order of the simultaneous drive and the selective drive while the valve member is opened may be interchanged.

The suction operation of the suction pumps may be continued for a predetermined time period even after the final step of opening the valve members.

The apparatus may be configured so as to further comprise: an ink reservoir for supplying ink to the recording head via a channel; a first valve member provided in the channel, the valve member opened when the negative pressure is sufficiently accumulated within the interior space of the cap unit; at least two suction ports formed on the cap unit so as to be spaced apart from each other and connected to the respective suction pumps via the suction tubes; a second valve member provided in at least one of the suction tubes; and control means for opening/closing the second valve member and for simultaneously driving the suction pumps while the first valve member is closed.

The suction ports may be formed on a bottom face of the cap unit so as to be situated at both ends of a row of nozzle orifices for jetting ink most susceptible to an increase in viscosity while the nozzle-formed face of the recording head is sealed by the cap unit.

In the ink jet recording apparatus employing any one of the foregoing cleaning control methods, the carriage is moved to a non-print area (i.e., the home position) at a time during which cleaning operation is performed, and the nozzle-formed face of the recording head is sealed by means of the cap unit located in the home position.

The valve member disposed in the ink channel extending from the ink reservoir to the recording head is closed, and the suction pumps connected to the inlets formed in the cap unit are selectively actuated. Alternatively, the valve member located in the suction channels extending from the inlets to the suction pumps are opened and closed, whereby negative pressure selectively acts on the inlets formed so as to become apart from each other in the cap unit.

Consequently, negative pressure selectively acts on clogged nozzle orifices in the recording head from different directions, thus imparting vibration to ink solids present in the nozzle orifices. Alternately, ink actively comes into contact with the clogged nozzles as a result of flow of ink which migrates between the inlets formed in the capping member, thus promoting softening or dissolution of the ink solids.

After completion of the foregoing operation, the suction pumps are simultaneously actuated, so that negative pressure is accumulated. The valve member are opened in this state, and hence a fast ink flow can instantaneously arise in the ink channel. By means of the fast flow of ink, the solids that have already undergone vibration or have become softened can be removed. Further, air bubbles present in the ink channel can also be discharged by means of the fast ink flow, thereby recovering the functions of the recording head and maintaining high print quality of the recording apparatus.

Like in the previous case, a fast ink flow can be effected in the ink channel by means of accumulated negative pressure even by simultaneously actuating the suction pumps while the valve member disposed in the ink channels extending from the ink reservoir to the recording heads are closed, and by opening the valves while the suction pumps are selectively actuated. Simultaneously, the vibration is imparted to the ink flow, thereby promoting recovery of functions of the recording head.

In a case where a tube pump, for example, is used as the suction pump, the plurality of tube pumps are connected such that the drive shafts of the tube pumps are connected in tandem. Consequently, the volume occupied by the plurality of pumps can be reduced, thus preventing an increase in the size of the recording apparatus.

DETAILED DESCRIPTION OF THE PREFERRED EMBODIMENTS

Figure 1:
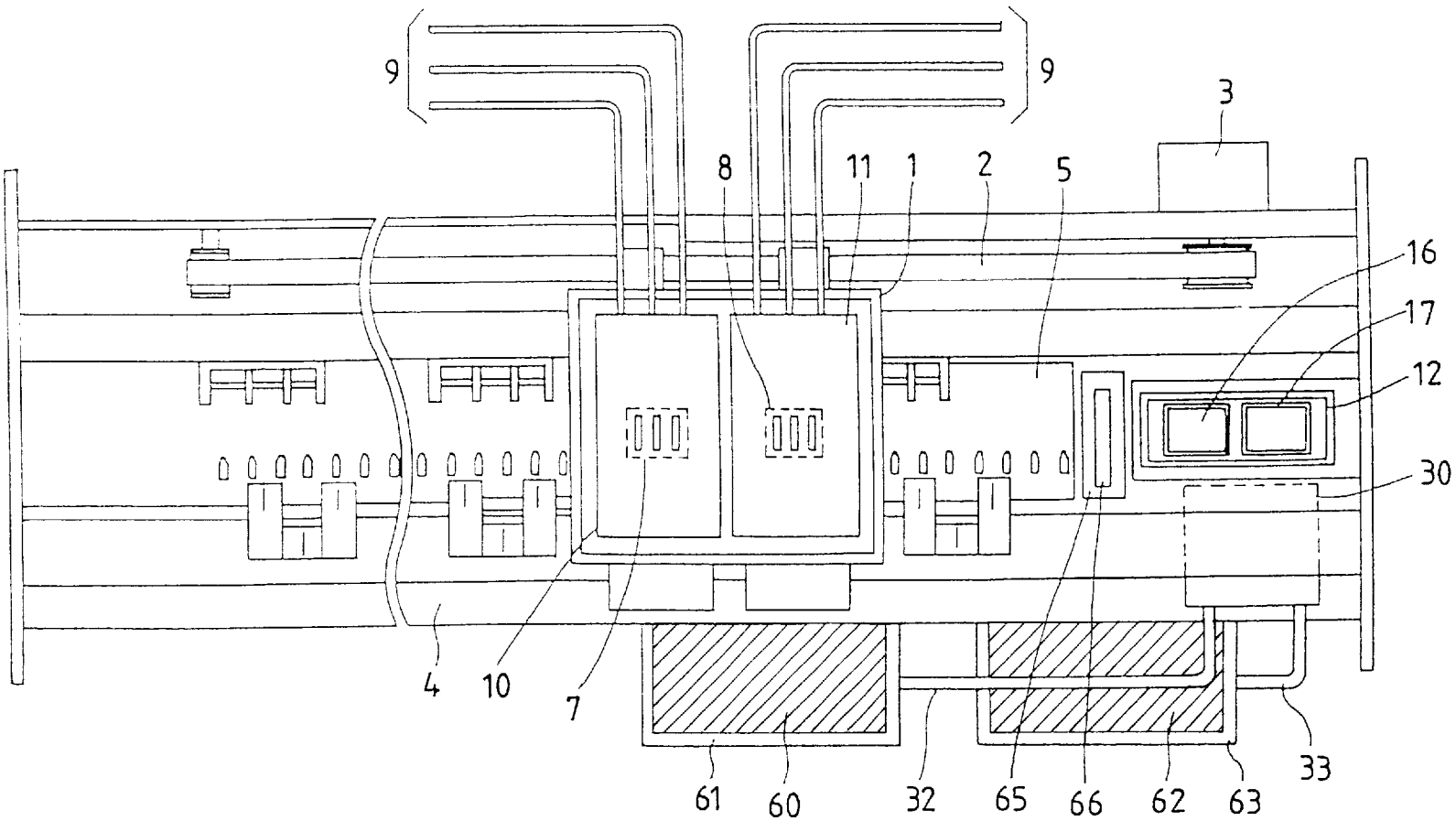
FIG. 1 is a top view showing the entire configuration of an ink jet recording apparatus according to a first embodiment of the present invention.

An ink jet recording apparatus according to the present invention will be described hereinbelow by reference to illustrated embodiments. FIG. 1 is a top view showing the overall configuration of a recording apparatus according to a first embodiment of the present invention. In FIG. 1, reference numeral 1 designates a carriage which is guided along a guide member and travels back and forth in a longitudinal direction of a paper guide member 5, by way of a timing belt 2 actuated by a carriage motor 3. A first recording head 7 and a second recording head 8 are mounted on an upper face of the carriage 1 facing a recording sheet, side by side in the direction of movement of the carriage 1.

Sub-tank units 10 and 11 having a dumping capability for supplying ink to the first and second recording heads 7 and 8 are mounted on the upper face of the carriage 1. Ink is supplied to the sub-tank units 10 and 11 from an unillustrated ink cartridge by way of ink supply tubes 9.

In a non-printing area on the channel along which the recording heads 7 and 8 travel, there is provided a capping device 12 for sealing a nozzle plate, in which nozzle orifices are formed, of the recording heads 7 and 8.

Figure 2:
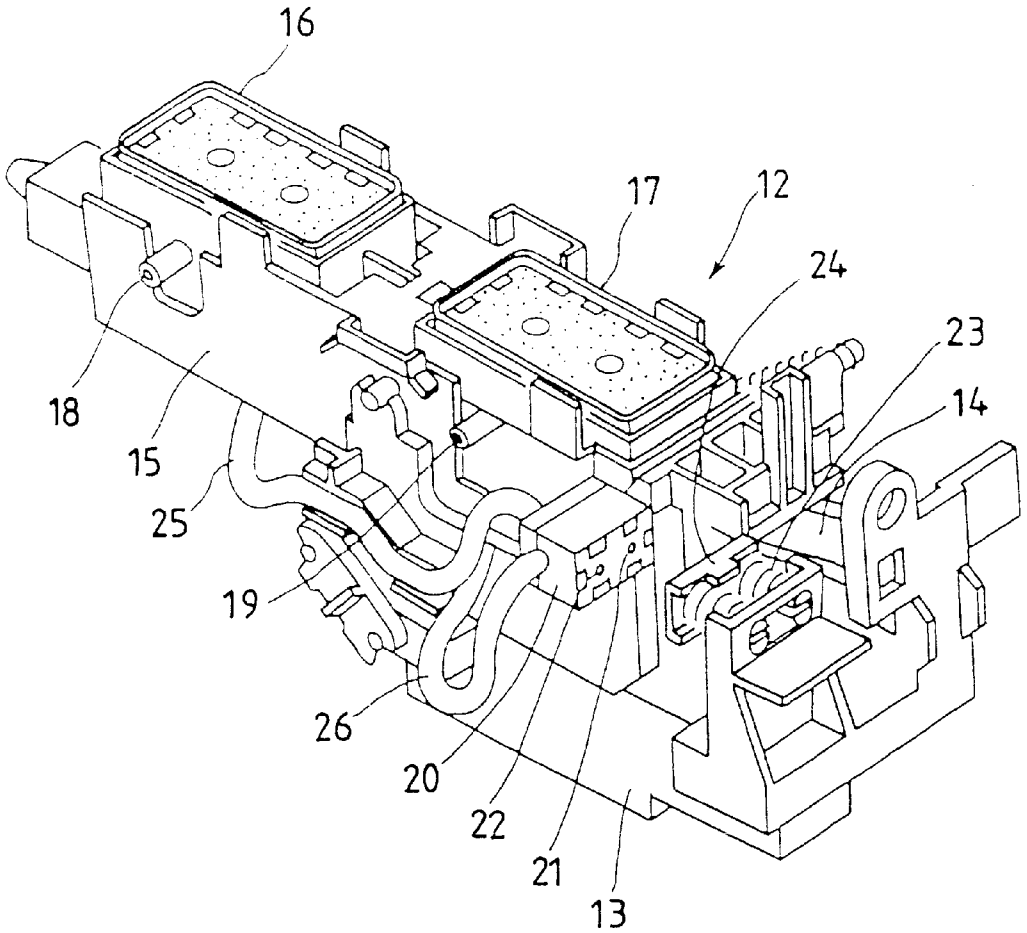
FIG. 2 is a perspective view showing one example of a capping device mounted on the recording apparatus shown in FIG. 1.

The capping device 12 is provided with a slider 15. As shown in FIG. 2, when the carriage I has moved to the non-printing area, the slider 15 moves up and down while traveling over a guide face 14 formed on a basement 13 so as to follow the movement of the carriage 1. The slider 15 is provided with cap units 16 and 17 for sealing the recording heads 7 and 8, respectively.

In the cap unit 16, there is formed an inlet 18 to be connected to an end 32*a* of a tube 32 of a suction pump (pump unit) 30 to be described later. In the cap unit 17, there is formed an inlet 19 to be connected to an end 33*a* of a tube 33 of the suction pump 30. A tube 25 whose one end is connected to an air hole 21 of a valve seat member 20 is connected at its other end to the cap unit 16, and a tube 26 whose one end is connected to an air hole 22 of the valve seat member 20 is connected at its other end to the cap unit 17.

In the area where the valve seat member 20 is situated when the cap units 16 and 17 have traveled to the position where they can seal the recording heads 7 and 8, there is provided a valve member 24 which is urged toward the valve seat member 20 at all times by means of a spring 23. In conjunction with the valve member 24, the valve seat member 20 constitutes an air valve.

In a print area with respect to the capping device 12, there is disposed a cleaning unit 65 equipped with a wiping blade 66. The wiping blade 66 is brought into elastic contact with the nozzle plates of the recording heads 7 and 8 that travel in association with the actuation of the carriage 1. The wiping blade 66 of the cleaning unit 65 is arranged so as to be able to travel back and forth horizontally along the travel channel of the recording heads 7 and 8, by means of the power of a drive source for driving the pump unit 30, to be described later.

Figure 3:
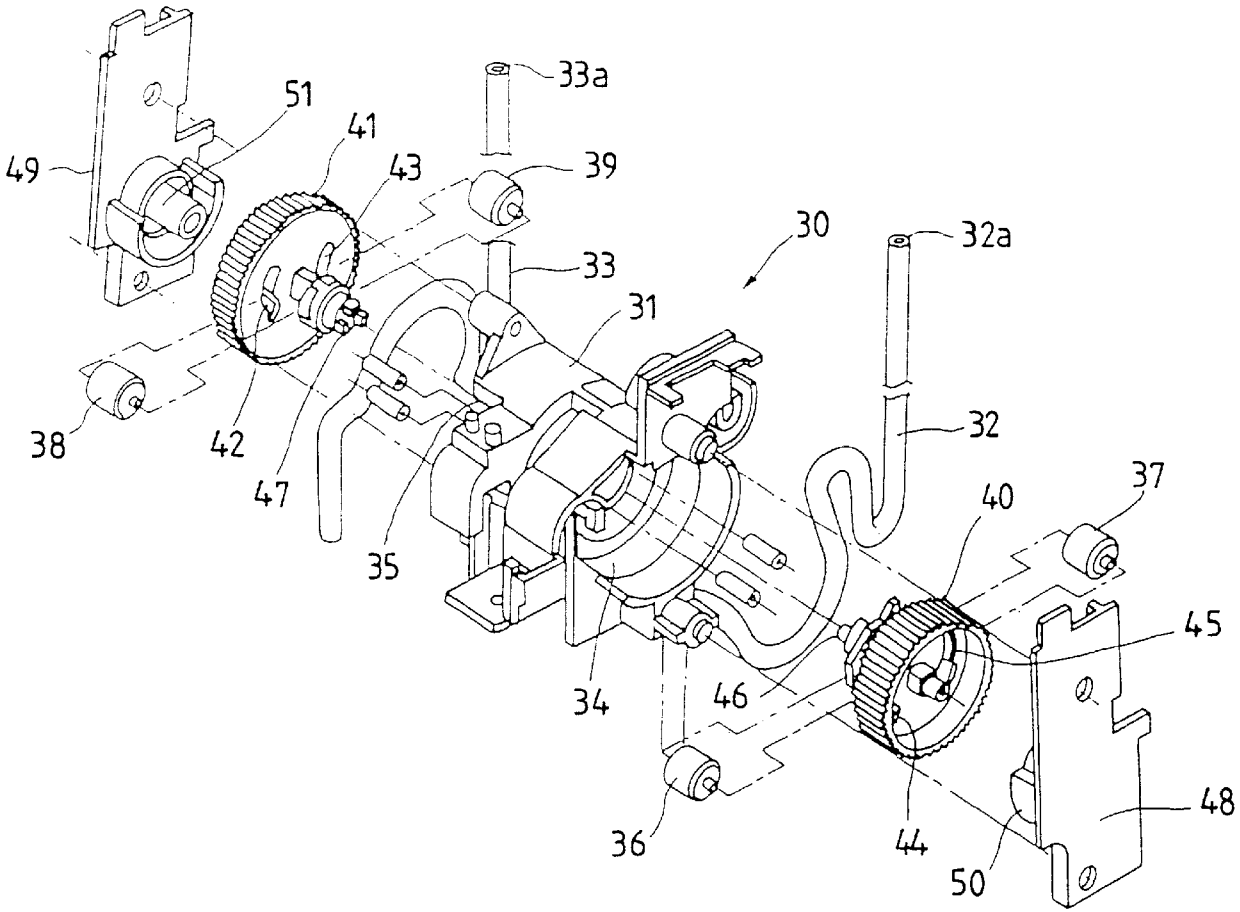
FIG. 3 is an exploded perspective view showing one example of a pump unit mounted on the recording apparatus shown in FIG. 1.

FIG. 3 is an exploded perspective view showing one example of the pump unit. In the present embodiment, negative pressure is simultaneously applied to the two cap units 16 and 17. For this reason, in a pump frame 31 which also serves as a substrate, there are formed into a substantially semicircular-shaped tube support surfaces 34 and 35 for supporting the tubes 32 and 33 therealong, so as to constitute two tube pumps. The tube support surfaces 34 and 35 are integrally attached together such that their backs face each other.

Pump wheels 40 and 41 have cylindrical outer wheels which mesh with a row of wheels driven by the unillustrated paper feed motor that act as the power source. In the pump wheel 40, support grooves 42 and 43 are formed so as to extend around the center of the wheel while being directed to the outer periphery thereof. In the pump wheel 41, support grooves 44 and 45 are formed so as to extend around the center of the wheel while being directed to the outer periphery thereof. A roller 36 is supported on the support groove 44 in a rotatable manner, and a roller 37 is supported on the support groove 45 in the same manner. Further, a roller 38 is supported on the support groove 42 in a rotatable manner, and a roller 39 is supported on the support groove 43 in the same manner. The pump wheels 40 and 41 are provided within the pump frame 31, whereby the individual rollers 36, 37, 38, and 39 are located inside the respective tubes 32 and 33.

By employment of the foregoing configuration, when the pump wheels 40 and 41 are rotated in one direction, the pair of rollers 36 and 37 and the pair of rollers 38 and 39 travel toward the outside along the corresponding support grooves 42, 43, 44, and 45, thus bringing the tubes 32 and 33 into pressing contact with the tube support surfaces 34 and 35. Accordingly, the tubes 32 and 33 are squeezed. In association with the rotation of the individual rollers 36, 37, 38, and 39, the tubes 32 and 33 act as suction pumps and impart negative pressure to the internal spaces of the respective cap units 16 and 17, by way of the inlets 18 and 19 formed in the cap units 16 and 17.

In contrast, when the pump wheels 40 and 41 are rotated in another direction, the pair of rollers 36 and 37 and the pair of rollers 38 and 39 travel toward the inside along the support grooves 42, 43, 44, and 45 formed on the pump wheels 40 and 41, thereby bringing the tubes 32 and 33 out of pressing contact with the rollers 36, 37, 38, and 39. The tubes 32 and 33 are thus released.

Figure 4:
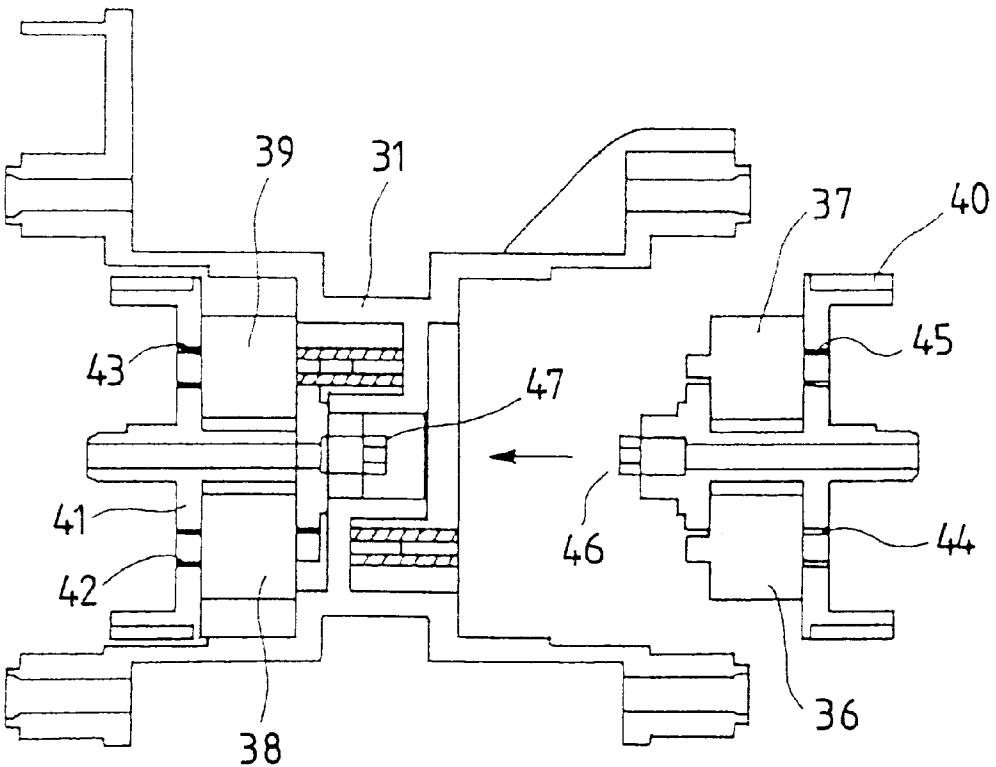
FIG. 4 is a section view showing a portion of structure of the pump unit.

As shown in FIG. 4, an engagement member 46 is formed at the center axis of the pump wheel 40, and an engagement member 47 is formed at the center axis of the pump wheel 41. The engagement members 46 and 47 are provided so as to face each other and are engaged with and connected to each other in the direction of rotation within the pump frame 31.

Figure 5B:
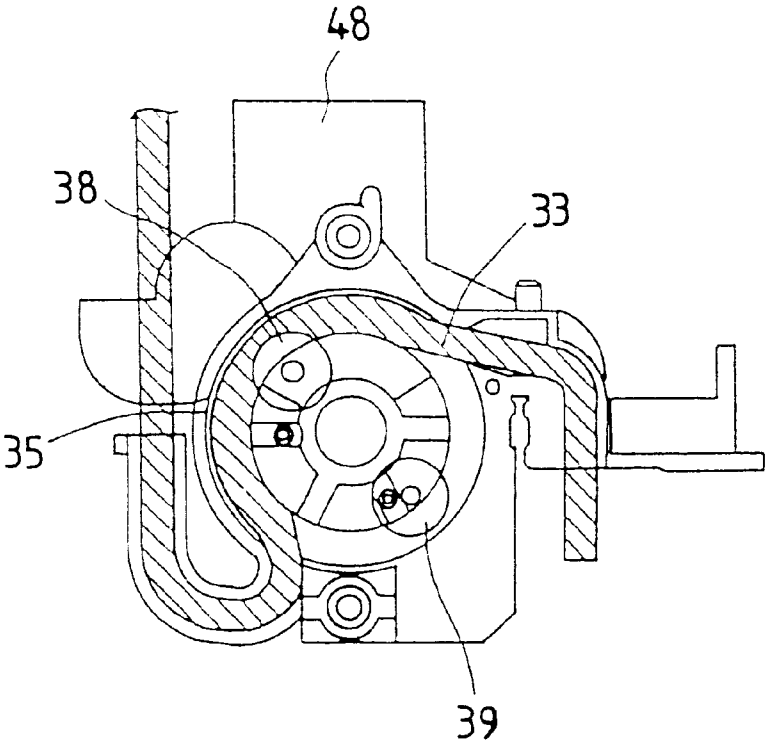
FIGS. 5A and 5B are section views showing the positions of rollers with respect to a tube within the pump unit.
Figure 5A:
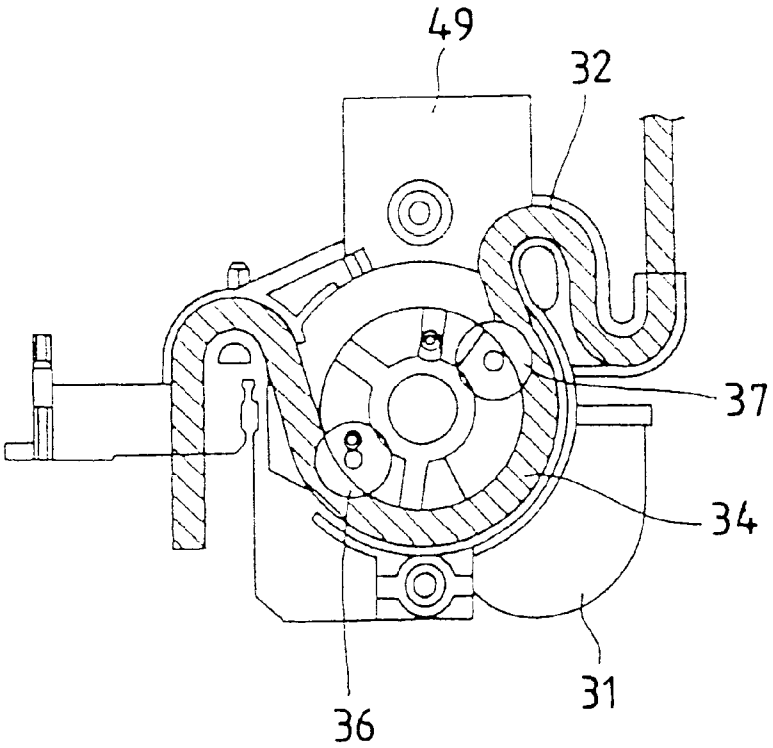

As shown in FIGS. 5A and 5B, the angle of engagement of the engagement members 46 and 47 is controlled such that the squeezing (pressing) of the tube 32 by means of the rollers 36 and 37 in one pump and the squeezing (pressing) of the tube 33 by means of the rollers 38 and 39 in another pump are about 90° out of phase with each other with reference to the direction of rotation of the pump wheels 40 and 41.

As shown in FIG. 3, the pump wheel 40 is rotatably supported on a cylindrical holder 50 attached to a support plate 48, and the pump wheel 41 is rotatably supported on a cylindrical holder 51 attached to a support plate 49. The support plates 48 and 49 are integrally attached to the pump frame 31 by means of unillustrated screws, thus constituting the pump unit 30.

As shown in FIG. 1, outlets of the tubes 32 and 33 constituting the pump unit 30 are connected to waste-ink tanks 61 and 63 housing waste-fluid absorbing members 60 and 62.

In the previously-described embodiment, when power is applied to the recording apparatus or when there is a need to forcibly discharge ink from the recording heads 7 and 8 after replacement of unillustrated ink cartridges or to refill the ink cartridge with ink, the carriage motor 3 is actuated, to thereby move the carriage 1 to a position where the recording heads 7 and 8 can be sealed by means of the capping device 12. The cap units 16 and 17 are moved over and raised from the basement 13 in association with the recording heads 10 and 11, thus sealing the recording heads 10 and 11. Further, the air holes 21 and 22 of the cap units 16 and 17 are moved together with the valve seat member 20 and are brought into resilient contact with the valve member 24. Thus, the air holes 21 and 22 are sealed.

When the paper feed motor is driven in reverse in this state, at least one of the pump wheels 40 and 41 of the pump unit 30 is imparted with drive force from the paper feed motor and is rotated. As a result, the rollers 36 and 37 rotatably attached to the pump wheel 40 squeeze the tube 32, and the rollers 38 and 39 rotatably attached to the pump wheel 41 squeeze the tube 33 such that the pair of rollers 36 and 37 remain 90° out of phase with the pair of rollers 38 and 39, thereby simultaneously imparting negative pressure to the two cap units 16 and 17.

The recording heads 7 and 8 are imparted with negative pressure and discharge ink to the inside of the cap units 16 and 17 by way of nozzle orifices. After a predetermined amount of ink has been suctioned, the carriage 1 is moved to a recording area, to thereby breaking contact between the air holes 21 and 22 and the valve member 24 while the recording heads 7 and 8 are sealed by the cap units 16 and 17. The cap units 16 and 17 are released in the air.

If the pump unit 30 is again actuated in this state, only the ink discharged from the cap units 16 and 17 is sucked by the tubes 32 and 33, without involvement of flow of ink from the recording heads 7 and 8, and the ink is discharged to the respective waste-ink tanks 61 and 63.

In this way, since ink is discharged from the respective tubes 32 and 33 to the independent waste-ink tanks 61 and 63, the capabilities of the waste-fluid absorbing members 60 and 62 of the waste-ink tanks 61 and 63 are maximized, and the storage capability of the waste-ink tanks can be improved. Further, even when the tank is tilted, if the head is made small, leakage of a waste fluid (i.e., ink) can be prevented.

The pair of rollers 36 and 37 that impart negative pressure to the tube 32 and the pair of rollers 38 and 39 that impart negative pressure to the tube 33 operate while remaining about 90° out of phase with each other from the beginning of squeezing action until the end of the same. Accordingly, loads are averaged, and the drive source does not have to be a motor having a large output rating. Further, suction operation is performed simultaneously with squeezing of the tubes, thus shortening suction time.

Figure 6A:
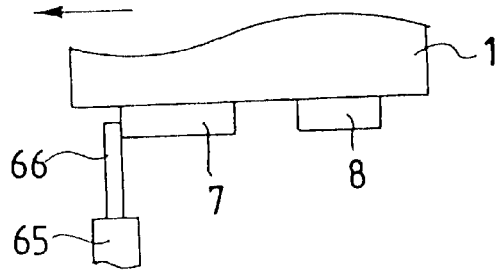
FIGS. 6A to 6F are diagrams showing processes of a method of cleaning the recording apparatus.
Figure 6B:
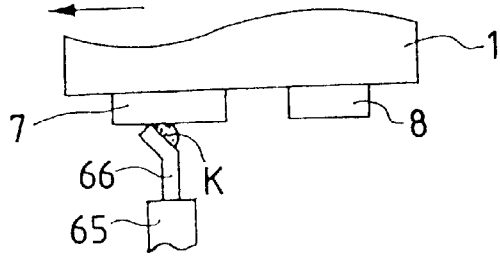

In the event that clogging arises in the recording heads 7 and 8, the paper feed motor is driven in reverse, thus enabling the wiping blade 66 to advance a travel region of the recording heads 7 and 8. If the recording heads 7 and 8 are moved in one direction in this state, as shown in FIG. 6A, the wiping blade 66 is brought into resilient contact with the first recording head 7, as shown in FIG. 6B, thereby scraping off, together with the ink K, waste-ink or paper dust adhering to the nozzle formation plane.

Figure 6C:
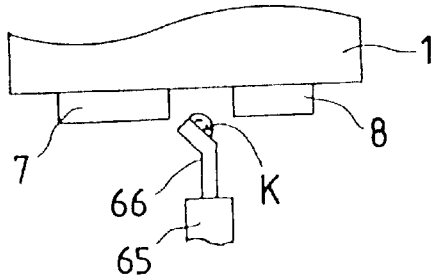
Figure 6D:
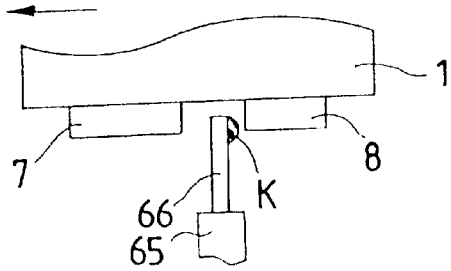

At a point in time when the wiping blade 66 comes to a position between the first and second recording heads 7 and 8 after completion of cleaning of the first recording head 7, the carriage motor 3 is deactivated, whereby the wiping blade enters a state shown in FIG. 6C. As shown in FIG. 6D, the resiliently-deformed wiping blade 66 returns to its original state.

Figure 6E:
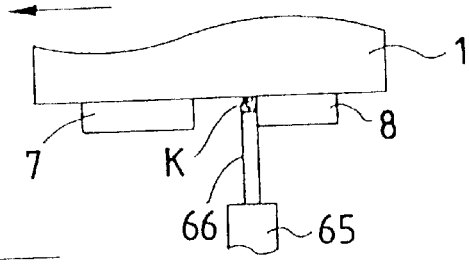
Figure 6F:
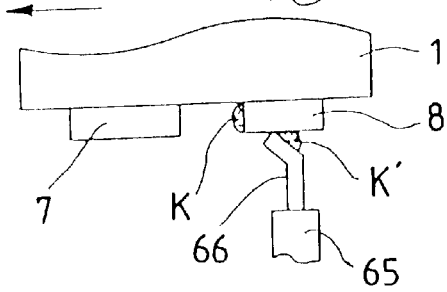

As mentioned above, after lapse of the time required for the wiping blade to return to its original state by means of the resiliency of the wiping blade; for example, 0.5 seconds, the carriage motor 3 is again activated in order to move the carriage 1. As shown in FIG. 6E, the ink K adhering to the tip end of the wiping blade 66 comes into contact with the side surface of the second recording head 8, so that the ink is scraped off from the wiping blade by the side surface. Subsequently, as shown in FIG. 6F, the wiping blade 66 wipes the nozzle formation plane of the second recording head 8. As a result, ink K' can be reliably scraped away from the second recording head 8 without involvement of adhesion of the ink scraped from the first recording head 7 onto the second recording head 8.

In a case where the two recording heads 7 and 8 are caused to perform continuous cleaning operation without interruption of movement of the carriage 1, a contact area between the ink K adhering to the wiping blade 66 that is resiliently deformed by the first recording head 7 and the side surface of the second recording head 8 becomes small, and a large amount of ink stills remain on the wiping blade 66. Consequently, there arises a problem of a reduction in the effect of cleaning the second recording head 8 and a problem of application of a large physical impact on the recording head 8 by means of restoration force of the wiping blade 66.

Consequently, the first and second recording heads 7 and 8 can be sufficiently cleaned by execution of the foregoing cleaning method. Further, the foregoing cleaning method can prevent damages to; for example, a meniscus formed over a nozzle orifice, which would otherwise be caused by application of physical shock to the second recording head 8.

Figure 7:
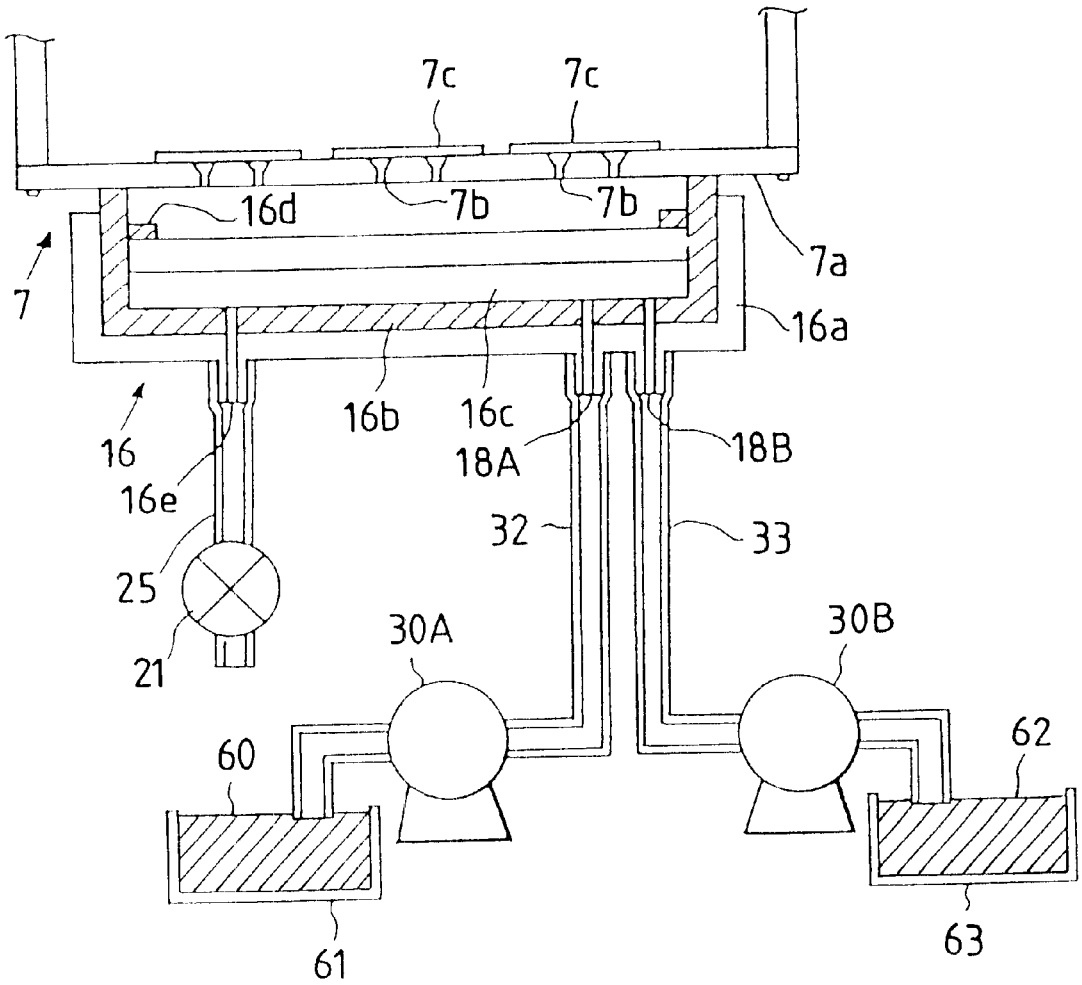
FIG. 7 is a section view showing a cap unit and suction channels in an ink jet recording apparatus according to a second embodiment of the present invention.

FIG. 7 shows a second embodiment of the present invention, in which negative pressure is imparted to the inside of the cap unit 16 through use of the suction pump 30 shown in FIGS. 3 through 5. Reference numeral 16 shown in FIG. 7 schematically shows the cross-section of a single cap unit. The cap unit 16 comprises a rectangular cap case 16a whose upper face is opened; and a cap member 16*b* formed from an elastic substance, such as rubber material, housed within the cap case 16*a*. The cap member 16*b* is formed such that the upper edge of the cap member 16*b* projects slightly beyond the cap case 16*a*.

An ink-absorbing member 16*c* formed from porous material is housed on the inner bottom of the cap member 16*b*. This ink-absorbing member 16*c* is retained by means of a retainer 16*d* integrally formed with the cap member 16*b*. Two inlets 18A and 18B and an air hole 16*e* are formed in the bottom portion of the cap case 16*a* so as to penetrate through the cap case 16*a* and the cap member 16*b*.

In the embodiment shown in FIG. 7, the two inlets 18A and 18B are drawn as being disposed side by side in the longitudinal direction of the cap unit 16. Preferably, the inlets 18A and 18B are formed in one longitudinal end of the inner bottom of the cap unit 16 so as to overlap each other in the direction perpendicular to the drawing paper of FIG. 7. More preferably, the inlets 18A and 18B are located as close to each other as possible. Preferably, the air hole 16*e* is formed in the other longitudinal end opposite the end of the cap unit 16 where the inlets 18A and 18B are formed.

By means of the inlets 18A and 18B and the air hole 16, in the case of discharge of ink from the cap unit 16, ink can be discharged from the inside of the cap unit 16 in one direction neatly, thereby reliably evacuating ink from the inside of the cap unit 16.

Reference numeral 7 shown in FIG. 7 designates the cross-section of one of the recording heads whose nozzle formation planes are sealed by means of the cap unit 16. As mentioned previously, the recording head 7 is configured such that the nozzle formation plane; that is, a nozzle plate 7*a,* is capped by the cap unit 16 when the cap unit 16 is moved upward. Nozzle orifices 7*b* are formed in the nozzle plate 7*a* and are arranged so as to be able to eject ink by means of action of a piezoelectric vibrators 7*c* arranged so as to correspond to the respective nozzle orifices 7*b*.

The tube 32 is connected to the inlet 18A formed in the cap case 16*a,* and the tube 33 is connected to the inlet 18B formed in the same. As shown in FIG. 3, the tubes 32 and 33 constitute a part of the pump unit (or tube pump). An outlet of a pump unit 30A constituted of the tube 32 is connected to the waste-ink tank 61, which houses the waste-fluid absorbing member 60. Further, a pump unit 30B constituted of the other tube 33 is connected to the waste-ink tank 63, which houses the waste-fluid absorbing member 62. The air hole 16*e* formed in the cap case 16*a* is connected to the tube 25, and the tube 25 is connected to the air hole 21 of the valve seat member 20, thus constituting an air valve, as shown in FIG. 2.

By means of the configuration shown in FIG. 7, the inside space of the cap unit 16 is evacuated and imparted with negative pressure by the two suction pumps 30A and 30B, which receive power from a single drive source and perform suction operations simultaneously.

As a result, a rising characteristic relating to suction of ink by way of the individual nozzle orifices 7*b* of the recording head 7 can be improved greatly. Consequently, the flow rate at which ink is suctioned from the recording heads can be increased to a predetermined flow rate immediately after actuation of the pump, thereby enabling quick discharge of air bubbles that have entered the recording heads.

Eventually, there can be yielded advantages of shortening the time required for suction of ink and reliable discharge of air bubbles from the inside of the recording head.

In the embodiment shown in FIG. 7, two tube pumps are disposed so as to correspond to a single cap unit. In this case, if the recording apparatus is equipped with two cap units, as shown in FIG. 2, four tube pumps are required. This configuration can be implemented without involvement of an increase in the volume occupied by the tube pumps, by connecting the drive shafts of the individual tube pumps in tandem. When compared with the designing of a pump layout in a case where the radius of the circular-arch tube is increased for the purpose of increasing the capacity of the tube pump, design of a pump layout in the foregoing configuration is much easier. The overall size of the recording apparatus can be made compact while the suction capability of the pump is increased.

Figure 8:
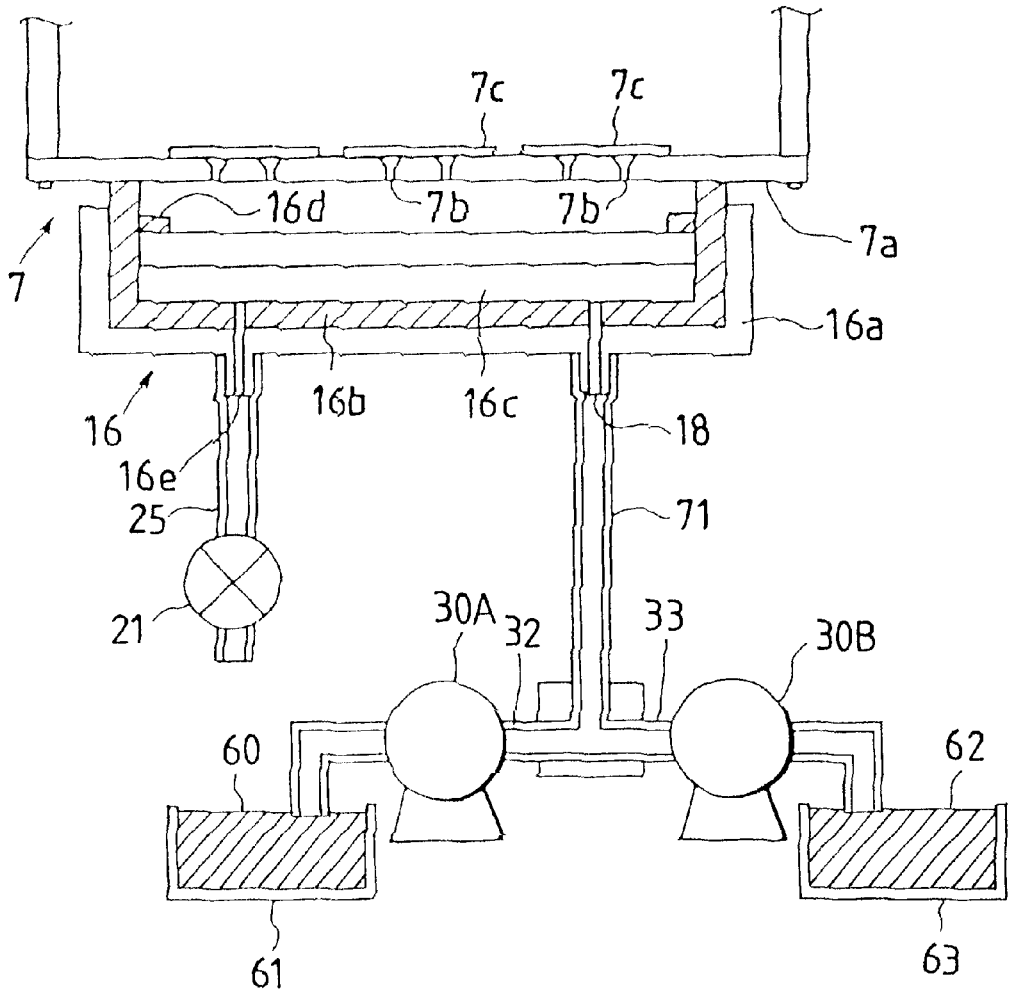
FIG. 8 is a section view showing a cap unit and suction channels in an ink jet recording apparatus according to a third embodiment of the present invention.

FIG. 8 shows a third embodiment, in which negative pressure is imparted to the inside of the cap unit 16 through use of a similar pump unit. In FIG. 8, those reference numerals that are the same as those used in FIG. 7 designate the same elements, and repetition of their explanations is omitted here for brevity.

In the embodiment shown in FIG. 8, a tube 71 is connected to a single inlet 18 formed in the cap unit 16. The other end of the tube 71 is bifurcated into the tube 32, which constitutes the suction pump 30A, and the tube 33, which constitutes the suction pump 30B.

In the configuration shown in FIG. 8, the suction side of the tube 32 facing the suction pump 30A and the suction side of the tube 33 facing the suction pump 30B, the tubes 32 and 33 being bifurcated from the tube 71, are drawn to substantially the same length. The lengths of the tubes 32 and 33 can be effectively utilized as means for controlling the suction capability of the suction pumps 30A and 30B. Specifically, if the lengths of the tubes 32 and 33 are identical, the suction pumps 30A and 30B can be controlled so as to assume substantially the same suction capability. In this case, preferably, the waste-fluid absorbing members 60 and 62 housed in the respective waste-ink tanks 61 and 63 are set so as to be substantially identical in size.

In contrast, if the tubes 32 and 33 are set so as to differ in length from each other; for example, if the suction-side portion of the tube 33 is set so as to become longer than the suction-side portion of the tube 32, the suction capability of the suction pump 30A connected to the tube 32 can be set higher than the suction capability of the suction pump 30B connected to the tube 33. Accordingly, the waste-ink tank 61 and the waste-fluid absorbing member 60 housed therein can be set so as to become larger, whereas the waste-ink tank 63 and the waste-fluid absorbing member 62 housed therein can be set so as to become smaller. Thus, the degree of freedom of layout of the individual ink tanks 61 and 63 can be improved.

Measure for making the inner diameters of the tubes 32 and 33 bifurcated from the tube 71 different may also be employed as means for controlling the suction capability of the individual suction pumps 30A and 30B. In this case, suction resistance of the suction pump having a larger inner diameter can be reduced, and the suction capability of the pump can be improved accordingly.

Figure 9:
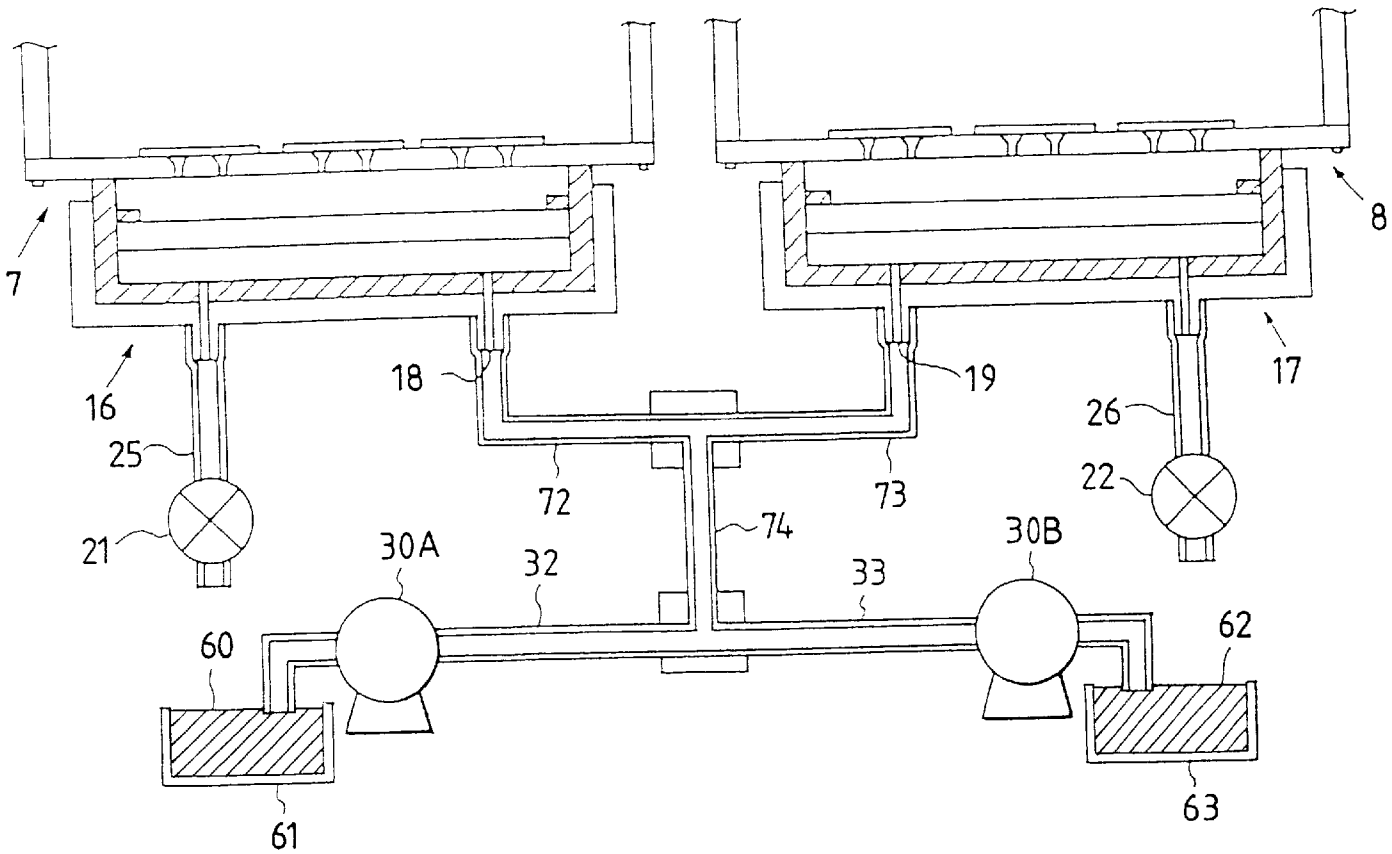
FIG. 9 is a section view showing a cap unit and suction channels in an ink jet recording apparatus according to a fourth embodiment of the present invention.

FIG. 9 shows a fourth embodiment of the present invention, in which negative pressure is imparted to the inside of the cap units through use of a similar pump unit. In a configuration shown in FIG. 9, a tube 72 is connected to the inlet 18 formed in the cap unit 16, and a tube 73 is connected to an inlet 19 formed in a cap unit 17. The tubes 72 and 73 are integrated into a single integrated section by means of one end of a tube 74, which constitutes a suction channel. The other end of the tube 74 is bifurcated into the tubes 32 and 33, which constitute the suction pumps 30A and 30B.

As in the case of the embodiment shown in FIG. 8, by means of the configuration, the suction capability of the suction pumps 30A and 30B can be controlled by making the lengths or inner diameters of the tubers 32 and 33 different from each other. Consequently, as in the case of the previous embodiment, the sizes of the waste-ink tank 61 and the waste-fluid absorbing member 60 housed therein or the sizes of the waste-ink tank 63 and the waste-fluid absorbing member 62 housed therein can be set appropriately.

Further, by means of the configuration shown in FIG. 9, the suction efficiencies of the cap units 16 and 17 can be controlled by rendering the connection tube 72, which connects the inlet 18 formed in the cap unit 16 to the tube 74, different in length or inner diameter from the connection tube 73, which connects the inlet 19 formed in the cap unit 17 to the tube 74.

Consequently, the suction efficiency of the cap unit 16 or 17 can be set according to the characteristics of waste-ink to be handled in the cap unit 16 or 17. According to the characteristics of ink to be handled or the number of nozzles provided in the recording head, the suction efficiency of the cap unit can be set rationally.

For example, in a cap unit for handling ink which is susceptible to an increase in viscosity, the suction efficiency of the cap unit is preferably set so as to become larger than that of a cap unit for handling ink least susceptible to an increase in viscosity. In this case, the tube connected to the cap unit for handling ink susceptible to an increase in viscosity is shortened, or a tube having a larger inner diameter is used as this tube, thus achieving an appropriate balance in the cap units in terms of suction efficiency.

Figure 10:
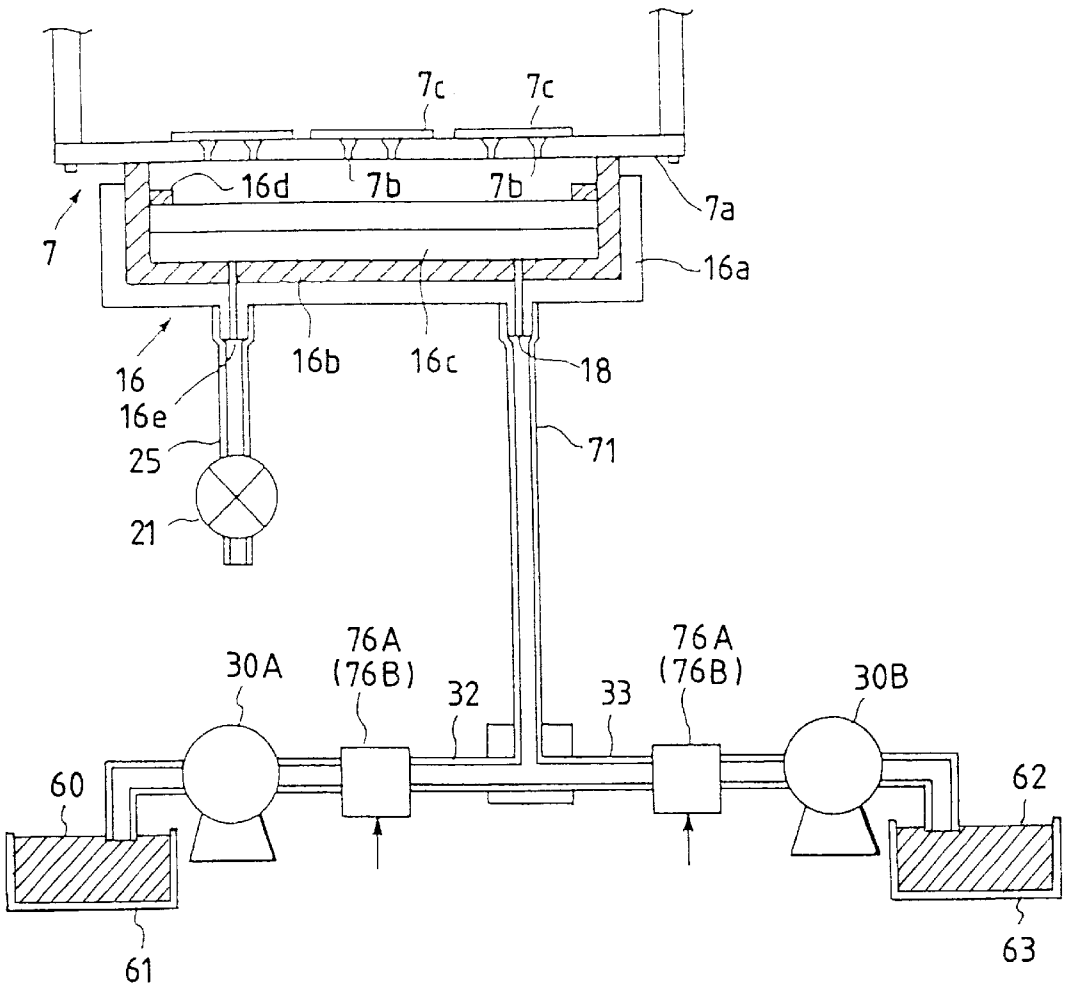
FIG. 10 is a section view showing a cap unit and suction channels in an ink jet recording apparatus according to a fifth embodiment of the present invention.

FIG. 10 shows a fifth embodiment of the present invention, in which negative pressure is imparted to the inside of the cap unit through use of a similar suction pump. The embodiment shown in FIG. 10 is based on the embodiment shown in FIG. 8. Therefore, like reference numerals designate like elements. In the embodiment shown in FIG. 10, valve member capable of opening or closing the suction channel is disposed in at least one of the suction channels extending from the bifurcation between the connection tubes to the individual suction pumps.

As shown in the drawing, the connection tube 71 is connected to the single inlet 18 formed in the cap unit 16, and the other end of the tube 71 is bifurcated into the tube 32 connected to the suction pump 30A and the tube 33 connected to the suction pump 30B. In this case, valve member 76A, which can open or close the suction channels and will be described later, is disposed in; e.g., the suction channels extending from the bifurcation of the connection tube 71 to the individual suction pumps 30A and 30B; i.e., the intermediate portions of the respective tubes 32 and 33. Alternatively, a variable flow register 76B, which can vary the resistance of the flow channel and will be described later, may be disposed in lieu of the valve member 76A.

By means of such a configuration, in a suction operation mode which does not require suction of a large amount of ink from the recording head (e.g., as will be described later, a manual cleaning operation performed by way of user's operation or a timer cleaning operation performed automatically during the idle operations of the recording apparatus), the amount of ink to be discharged can be controlled by closing the valve member 76A or choking the flow channel by means of the variable flow register 76B. Thus, the amount of ink to be supplied to the waste-ink tank can be reduced, and the interval for maintenance of the waste-ink tank can be prolonged. Further, the waste of ink of the ink cartridge can be reduced.

As in the case of the embodiment shown in FIG. 10, the valve member 76A or the variable flow register 76B, which may be provided in lieu of the valve member 76A, is not necessarily disposed in each of the two suction channels; i.e., a suction channel between the bifurcation of the tube 71 and the suction pump 30A and a suction channel between the bifurcation of the tube 71 and the suction pump 30B. The valve member 76A or the variable flow register 76B may be disposed in one of the two suction channels.

Figure 11:
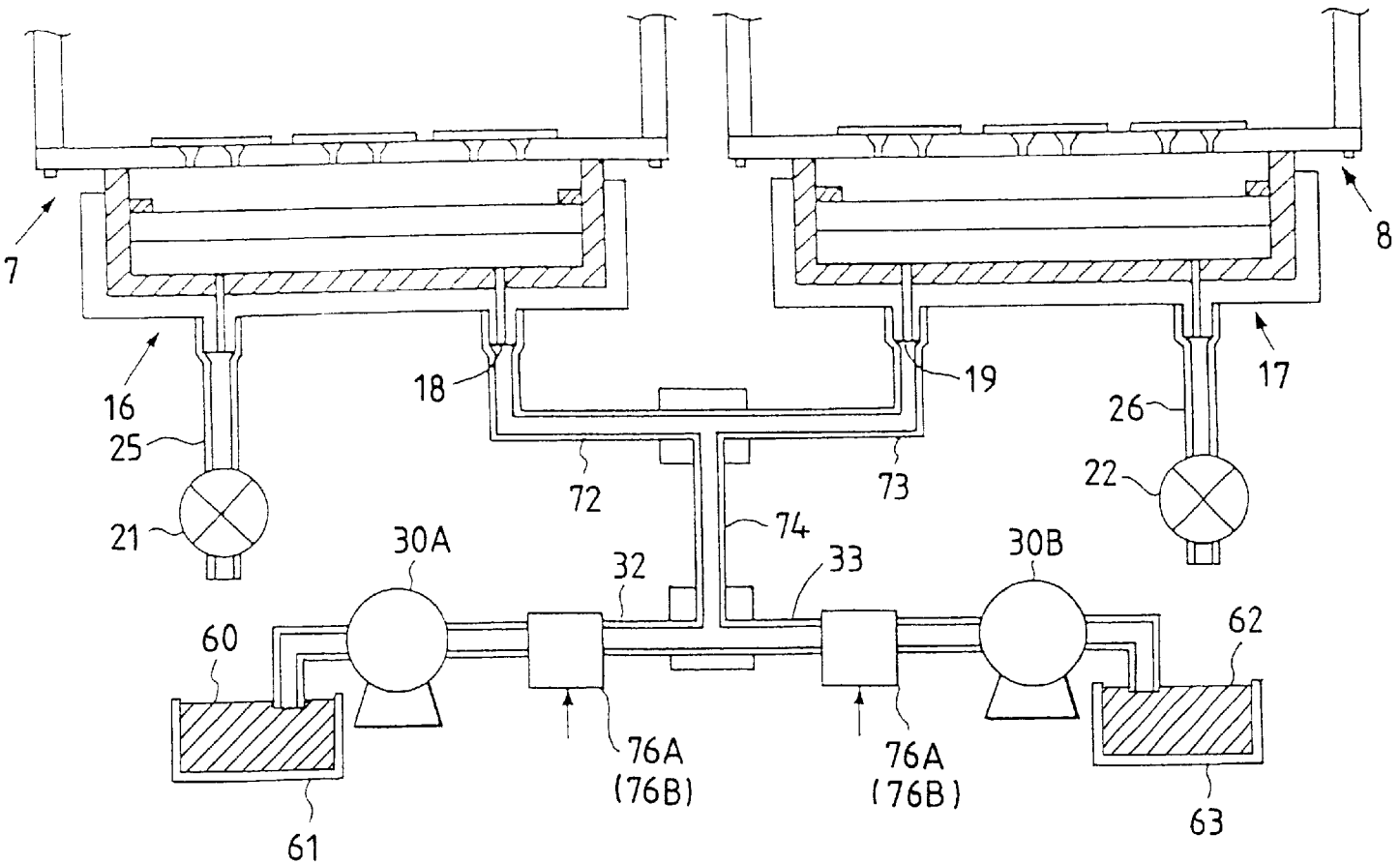
FIG. 11 is a section view showing a cap unit and suction channels in an ink jet recording apparatus according to a sixth embodiment of the present invention.

FIG. 11 shows a sixth embodiment of the present invention capable of yielding the same working effects and results as those yielded in the previous embodiments. The embodiment shown in FIG. 11 is based on the embodiment shown in FIG. 9, and like reference numerals designate like elements. Even in the embodiment shown in FIG. 11, the valve member 76A or the variable flow register 76B, which may be provided in lieu of the valve member 76A, is disposed in each of the two suction channels; i.e., the tube 32 between the bifurcation of a connection tube 74 and the suction pump 30A and the tube 32 between the bifurcation of the connection tube 74 and the suction pump 30B.

Even in the embodiment shown in FIG. 11, the valve member 76A or the variable flow register 76B, which may be provided in lieu of the valve member 76A, is not necessarily disposed in each of the two suction channels; i.e., a suction channel between the bifurcation of the tube 74 and the suction pump 30A and a suction channel between the bifurcation of the tube 74 and the suction pump 30B; alternatively, the valve member 76A or the variable flow register 76B may be disposed in one of the two suction channels.

Figure 12:
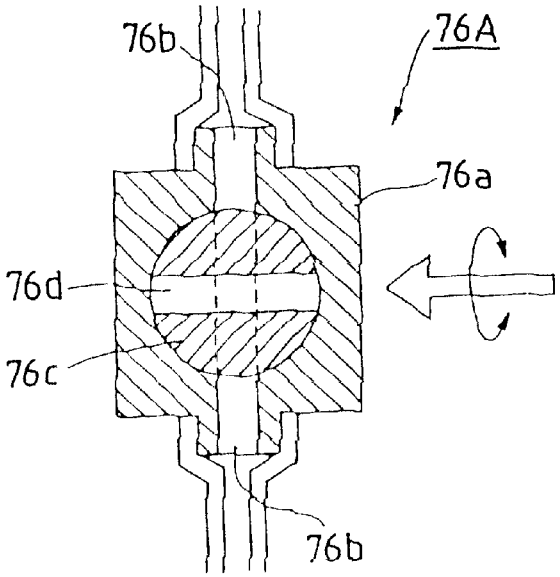
FIG. 12 is a section view showing one example of a valve member disposed in each of the suction channels.
Figure 13:
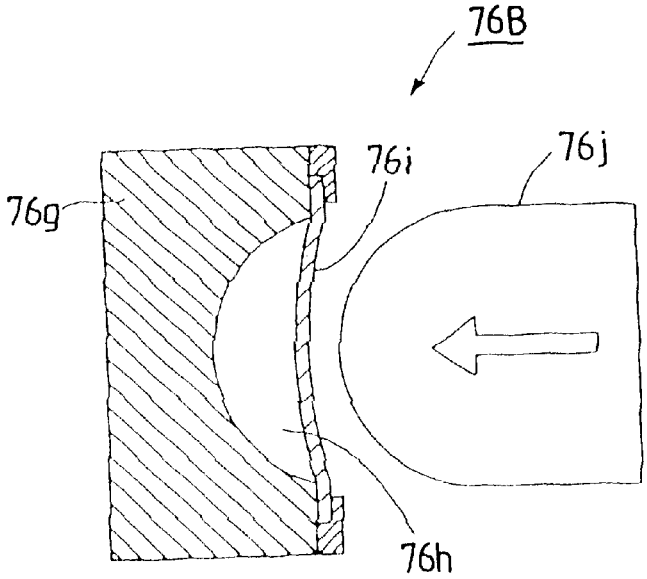
FIG. 13 is a section view showing one example of a variable flow resister disposed in each of the suction channels.

FIG. 12 shows one example of the basic configuration of the previously-described valve member 76A, and FIG. 13 shows one example of the basic configuration of the previously-described variable flow register 76B. The valve member 76A whose cross section is shown in FIG. 12 is connected between tubes constituting the suction channel and comprises a base member 76*a,* in which a communication hole 76*b* to be connected to the tubes is formed, and a shaft member 76*c* which is located in the base member 76*a* so as to be rotatable about a shaft hole formed in the base member 76*a*. A communication hole 76*d* is also formed in the shaft member 76*c*.

Selection can be made between a valve-closed state shown in the drawing and an valve-open state in which the communication holes are brought into alignment, by rotation and actuation of the shaft member 76*c* within a range of about 90° by means of an unillustrated actuator.

The variable flow register 76B whose cross section is shown in FIG. 13 comprises a base member 76*g,* and a communication hole 76*h* is formed in the base member 76*g* so as to assume a semi-circular cross section. An extendable elastic member 76*i* is attached to the opening of the communication hole 76*h* so as to hermetically seal the communication hole 76*h*. An actuating member 76*j* whose tip end is formed into a semi-circular columnar shape or a semi-spherical shape is brought into contact with substantially the center of the resilient member 76*i*.

By means of the foregoing configuration, the variable flow register 76B can change the resistance of the flow channel of the suction channel by the actuation member 76*j* being brought into contact with the elastic member 76*i* by means of drive force of the unillustrated actuator, and by the elastic member 76*i* being deformed toward the communication hole 76*h* according to the degree of contact.

The curvature of the communication hole 76*h* formed in the base member 76*g* is made substantially equal to the curvature of the tip end of the actuating member 76*j* (strictly, the curvature of the tip end of the actuating member 76*j* is diminished by an amount corresponding to the thickness of the deformed elastic member 76*i*). In a state in which the actuating member 76 has entered to the deepest position of the communication hole 76*h,* the suction channels can be closed. By means of the foregoing configuration, the valve opening and closing actions similar to those achieved by the valve member 76A shown in FIG. 12 can be achieved.

Figure 14:
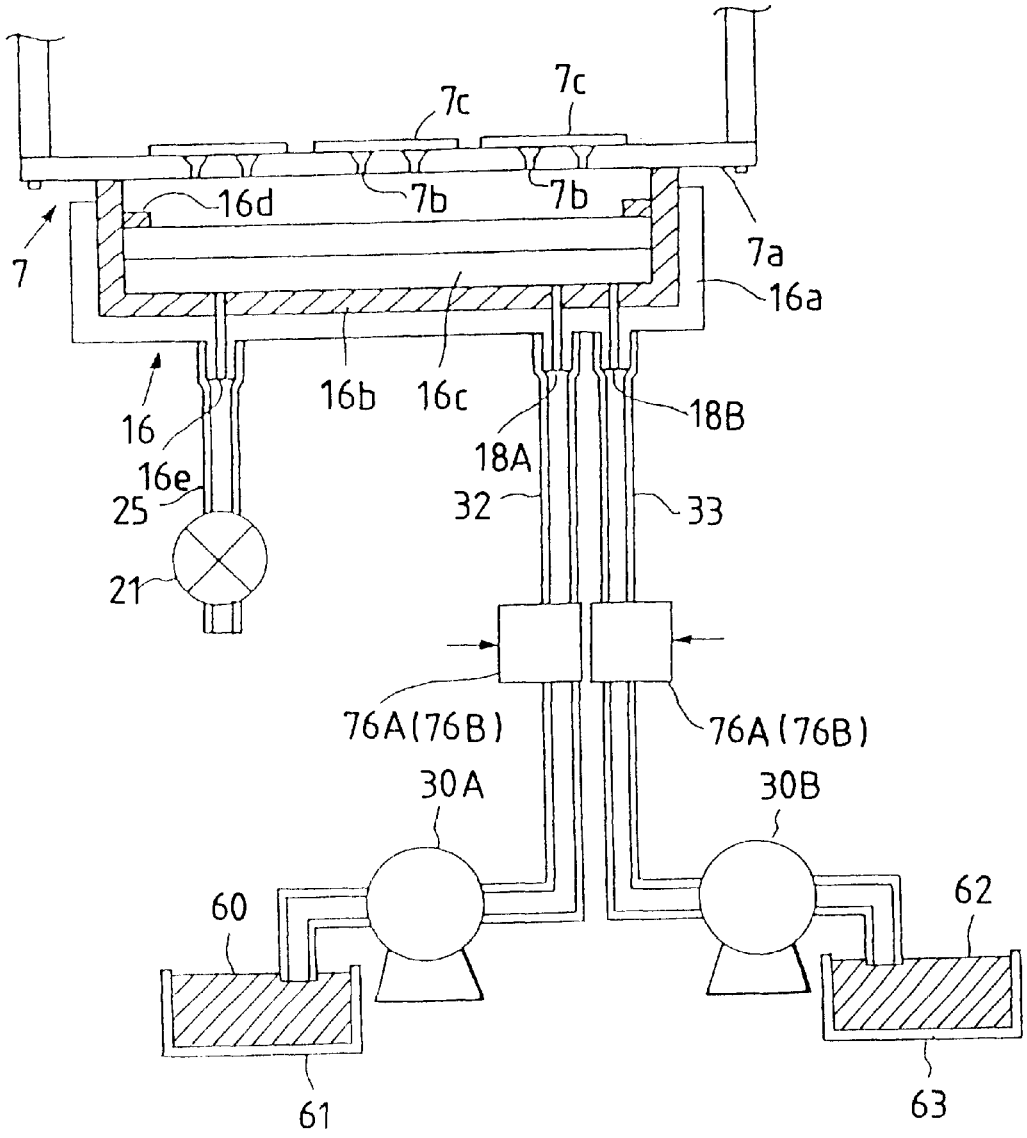
FIG. 14 is a section view showing a cap unit and suction channels in an ink jet recording apparatus according to a seventh embodiment of the present invention.

FIG. 14 shows a seventh embodiment of the present invention, in which the valve member 76A or the variable flow register 76B is used. The embodiment shown in FIG. 14 is based on that shown in FIG. 7, and like reference numerals designate like elements. In the embodiment shown in FIG. 14, at least one valve member capable of opening and closing a suction channel is disposed in at least one of a plurality of suction channels, each suction channel extending between an inlet formed in the cap unit, and a suction pump.

More specifically, in the embodiment shown in FIG. 14, the previously-described valve member 76A (see FIG. 12) is disposed in the tube 32 connecting an inlet 18A formed in the cap unit 16 to the pump unit 30A, as well as in the tube 33 connecting an inlet 18B formed in the cap unit 16 to the pump unit 30B. The previously-described variable flow register 76B (see FIG. 13) may be disposed in lieu of the valve member 76A.

By means of this configuration, in a suction mode in which there is no need to suction a large amount of ink from the recording head, the flow channel can be can be squeezed by closing the valve member 76A, as needed, or by activation of the variable flow register 76B. As a result, the amount of ink supplied to the waste-ink tank can be reduced, the interval for maintenance of the waste-ink tank can be extended, and the amount of ink stored in the ink cartridge that is wasted can be diminished.

As in the case of the embodiment shown in FIG. 14, the valve member 76A, or the variable flow register 76B provided in lieu of the valve member 76A, is not necessarily required to be disposed in both the tube 32 and the tube 33 constituting the suction channels; the valve member 76A or the variable flow register 76B may be disposed in either the tube 32 or the tube 33.

Figure 15:
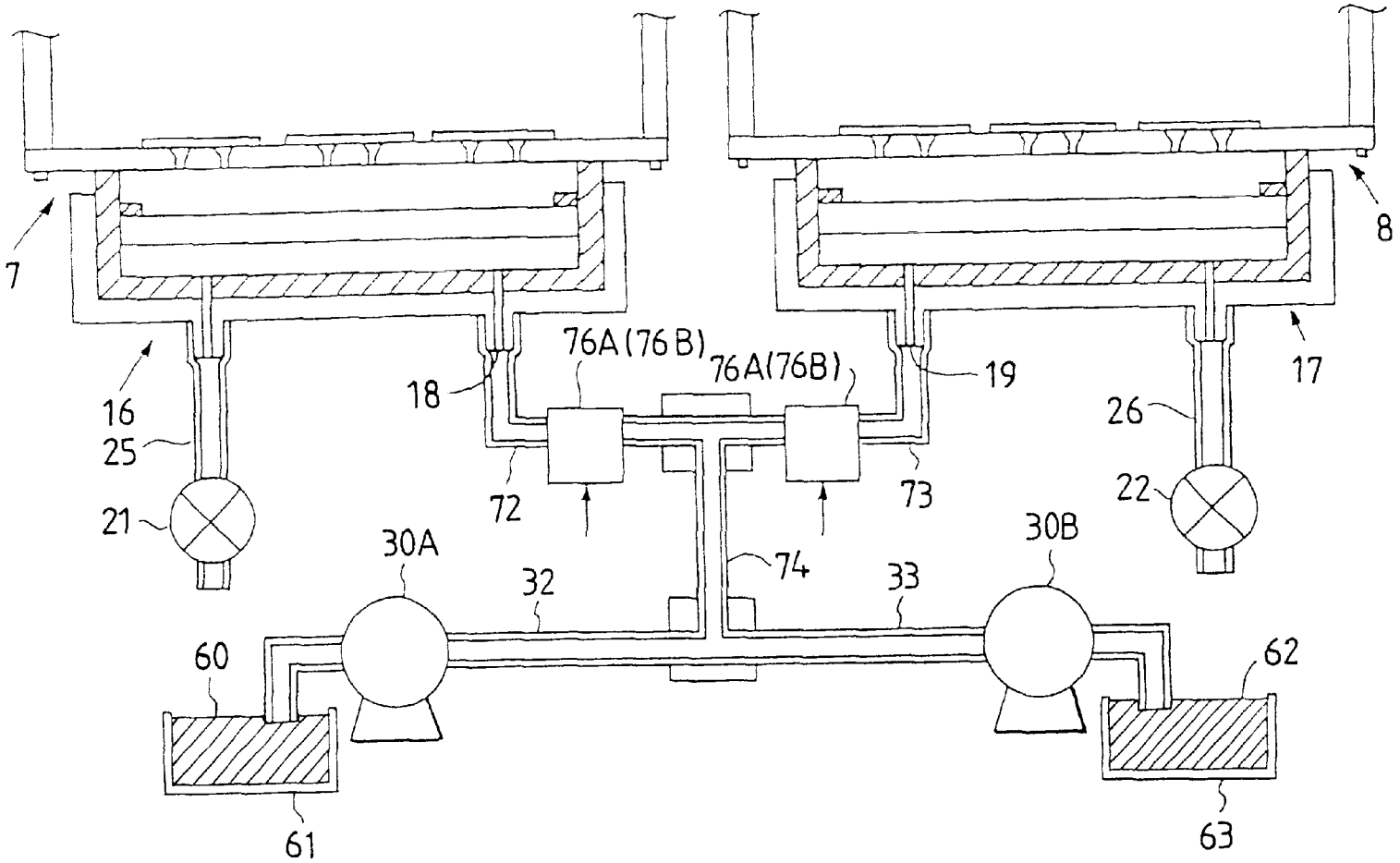
FIG. 15 is a section view showing a cap unit and suction channels in an ink jet recording apparatus according to an eighth embodiment of the present invention.

FIG. 15 shows an eighth embodiment of the present invention, in which the valve member 76A or the variable flow register 76B is employed. The embodiment shown in FIG. 15 is essentially based on the embodiment shown in FIG. 9, and like reference numerals designate like elements. In the embodiment shown in FIG. 15, valve member capable of opening or closing a suction channel, or variable flow register provided in lieu of the valve member, is disposed in at least one of a plurality of suction channels, each suction channel extending from an inlet formed in the first or second cap unit to a junction section.

More specifically, in the embodiment shown in FIG. 15, the valve member 76A, or the variable flow register 76B provided in lieu of the valve member 76A, is disposed in a suction channel (tube 72) extending between the inlet 18 formed in the first cap unit 16, and a junction section constituted of a tube 74, as well as in a suction channel (tube 73) extending between the inlet 19 formed in the second cap unit 17 and the junction section constituted of the tube 74.

This configuration enables control of the negative pressure imparted to each of the recording heads 7 and 8 sealed by the first and second cap units 16 and 17, through use of the valve member 76A or the variable flow register 76B provided in lieu of the valve member 76A. As in the case of the embodiment shown in FIG. 15, the valve member 76A, or the variable flow register 76B provided in lieu of the valve member 76A, is not necessarily required to be disposed in both the tube 72 and the tube 73 constituting the suction channels; the valve member 76A or the variable flow register 76B may be disposed in either the tube 72 or the tube 73.

In the configuration shown in FIG. 15, the valve member 76A or the variable flow register 76B is disposed in a suction channel of the cap unit which seals a recording head having a small number of nozzles or ejecting ink resistant to an increase in viscosity. As a result, a large suction flow can be imparted to a recording head which has a large number of nozzles or ejects ink susceptible to an increase in viscosity.

Figure 16:
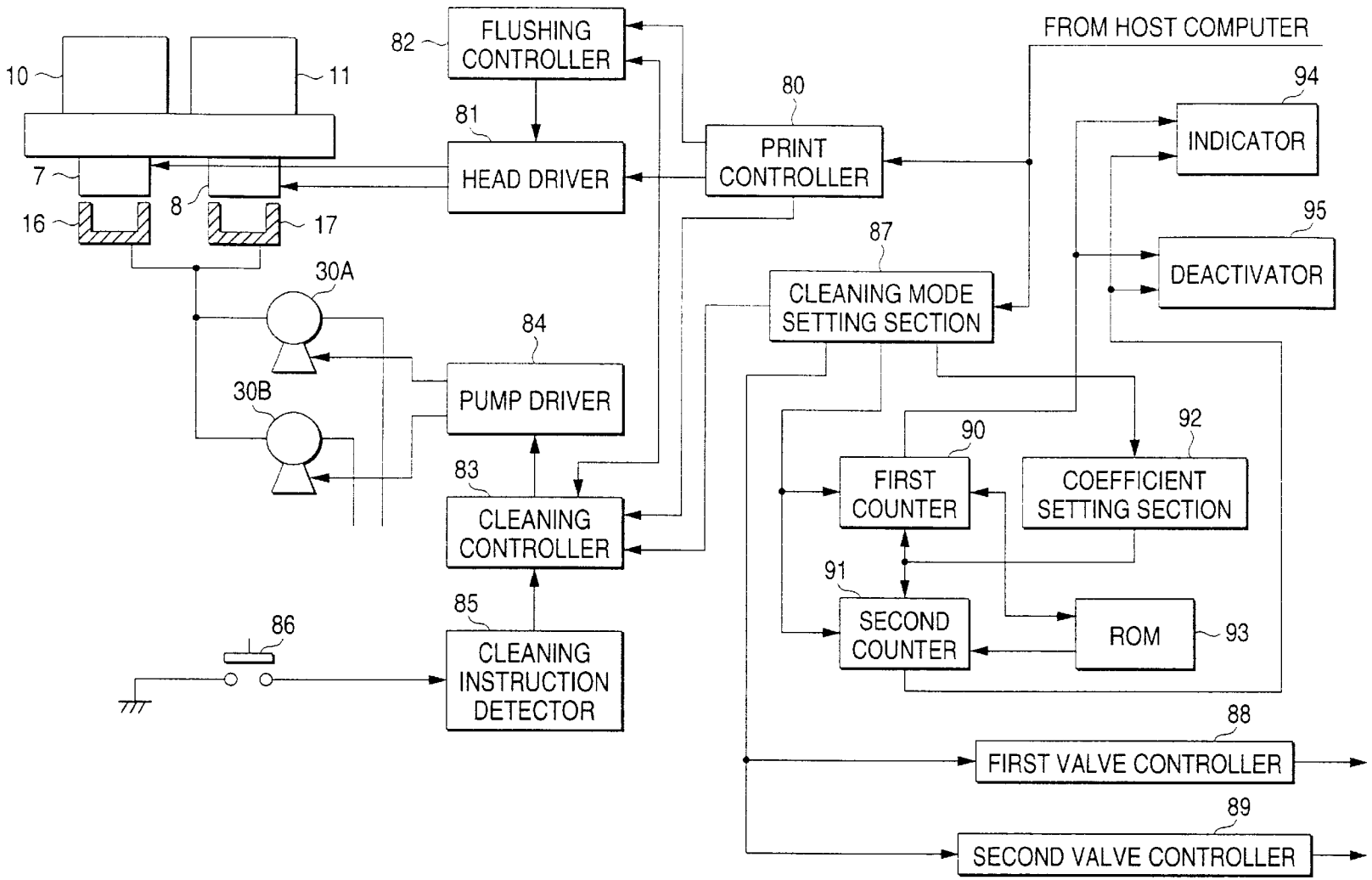
FIG. 16 is a block diagram showing one example of a management system for connecting the amount of ink flowing into a waste-ink tank.

FIG. 16 is a block diagram showing one example of a management system which counts and manages the amount of ink flowing into the waste-ink tank by means of suction action of each of the suction pumps. In FIG. 16, the same reference numerals as in previously described embodiments are assigned to the recording heads 7 and 8, the sub-tank units 10 and 11, the cap units 16 and 17, and the suction pumps 30A and 30B, and repetition of their explanations will be omitted here for brevity.

In FIG. 16, a print controller 80 generates bit-mapped data from print data transmitted from an unillustrated host computer, causes a head driver 81 to produce a drive signal on the basis of the bit-mapped data for causing the recording heads 7 and 8 to eject ink droplets. The head driver 81 is configured so as to output, in addition to the drive signal based on the print data, a drive signal for flushing operation to the recording heads 7 and 8, upon receipt of a flushing instruction signal transmitted from a flushing controller 82.

A pump driver 84 is activated upon receipt of an instruction from a cleaning controller 83, thereby activating and controlling the suction pumps 30A and 30B. Further, the cleaning controller 83 is configured so as to receive a cleaning instruction signal from the print controller 80, a cleaning instruction detector 85, and a cleaning mode setting section 87.

The cleaning instruction detector 85 is connected to an instruction switch 86. For example, the user manually depresses the instruction switch 86, to thereby activate the instruction detector 85. Consequently, the head cleaning operation is performed manually.

Upon receipt of an instruction from the host computer of the unillustrated recording apparatus, the cleaning mode setting section 87 sets a cleaning mode and sends to the cleaning controller 83 a cleaning instruction corresponding to the cleaning mode. The cleaning mode comprises, in addition to the previously-described timer cleaning operation, initial refilling operation for initially introducing ink to the recording apparatus and replacement cleaning operation, which is performed when an ink cartridge is replaced by a new ink cartridge.

The cleaning mode setting section 87 sends to the cleaning controller 83 a suction instruction based on an ink suction program which is previously set according to the cleaning mode. The cleaning controller 83 activates the pump driver 84, whereby the suction pumps 30A and 30B perform suction operations.

A first valve controller 88 and a second valve controller 89 are configured so as to activate and open or close an unillustrated actuator of the valve member 76A shown in FIG. 12, upon receipt of an instruction signal from the cleaning mode setting section 87. Alternatively, the valve controller 88 and 89 may be configured so as to active an unillustrated actuator of the variable flow register 76B shown in FIG. 13 and provided in lieu of the valve member 76A, to thereby control the resistance of the flow channel.

A first counter 90 counts the amount of ink flowing into the waste-ink tank 61 by means of the suction pump 30A which operates in association with the opening and closing action of the first valve controller 88. A second counter 91 counts the amount of ink flowing into the waste-ink tank 63 by means of the suction pump 30B which operates in association with the opening and closing action of the first valve controller 89.

The first and second counters 90 and 91 are configured so as to summate and count the amount of ink flowing into the respective waste-ink tanks 61 and 63, on the basis of parameters specified so as to correspond to an ink suction operation mode.

For instance, during the manual cleaning operation performed by way of the user's operation, an ink suction operation (large amount), a first ink suction operation (small amount), and a second ink suction operation (small amount) are performed in sequence. Parameters which are set beforehand according to the above respective operations are read from ROM 93. The counters 90 and 91 perform summation and counting operations in association with the opening or closing action of the valve controller 88 and 89.

In a case where the variable flow register 76B such as that shown in FIG. 13 is used, coefficients corresponding the resistance of the flow channel set by the valve controller 88 and 89 are provided to each of the counters 90 and 91, by a coefficient setting section 92. Consequently, the counts made by the counters 90 and 91 are corrected, summated, and counted again. The count made by the counter 90 corresponds to the amount of ink flowing into the waste-ink tank 61 is summated and managed according to the cleaning mode or the control status of the valve controller 88. The count made by the counter 91 corresponds to the amount of ink flowing into the waste-ink tank 63 is summated and managed according to the cleaning mode or the control status of the valve controller 89.

The count made by the counter 90 and the count made by the counter 91 are output to an indicator 94. When the count reaches one of predetermined threshold values managed by the respective waste-ink tanks 61 and 63, the indicator 94 displays the status of the waste-ink tank 61 or 63. Accordingly, the user can become aware that the amount of waste-ink in either the waste-ink tanks 61 and 63 exceeds the predetermined level.

The counters 90 and 91 output their counts to a deactivator 95. If the count reaches one of the predetermined threshold values managed by the waste-ink tanks 61 and 63, the deactivator 95 issues an instruction signal and forcibly stops use of the recording apparatus, thus preventing an overflow of waste-ink from the waste-ink tank 61 or 63, which would cause a failure of the recording apparatus.

Figure 17A:
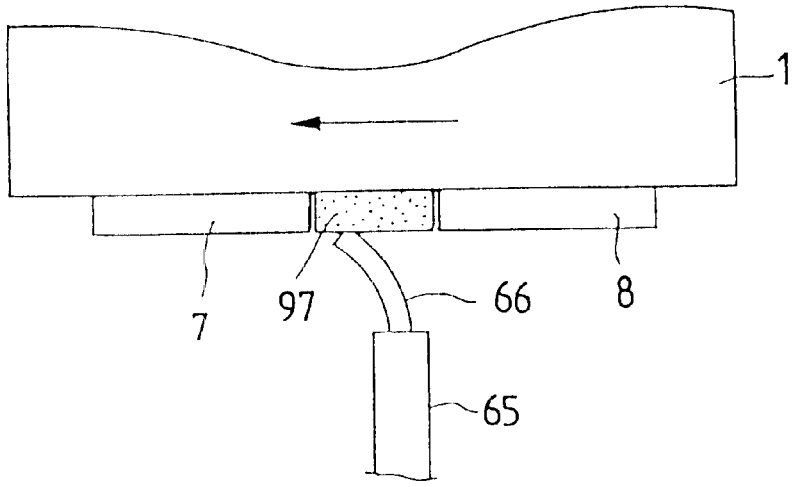
FIGS. 17A and 17B are side views showing the arrangement of a spacer provided on the carriage and an absorbing member provided on the capping member in an ink jet recording apparatus according to a ninth embodiment of the present invention.
Figure 17B:
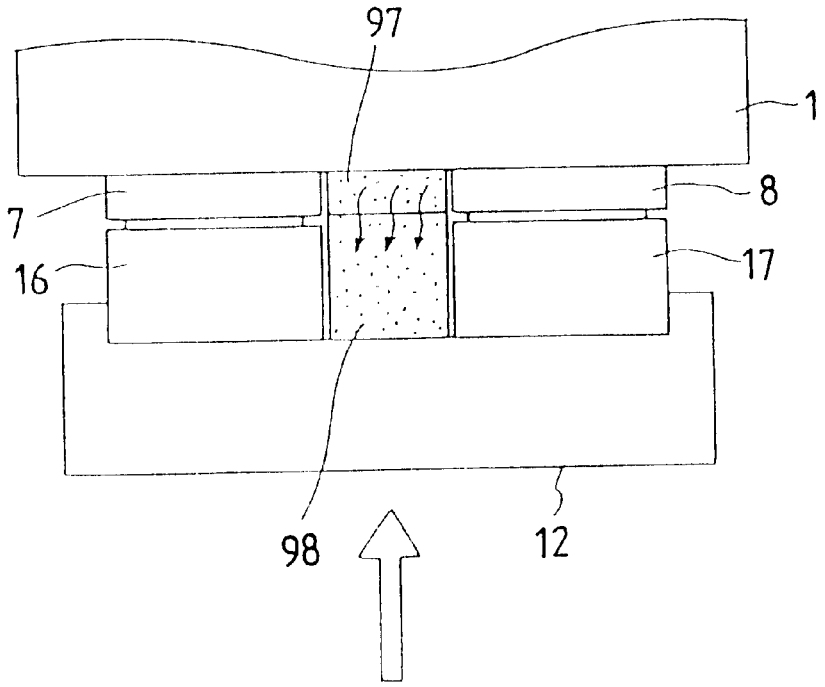

FIGS. 17A and 17B show a ninth embodiment of the present invention, in which ink adhering to the nozzle formation planes of the respective first and second recording heads is wiped away by means of a wiping blade after ink has been discharged from the recording heads by means of the foregoing configuration. As shown in FIG. 17A, a spacer 97 is interposed between the first and second recording heads 7 and 8 mounted on the carriage 1 so that a wiping blade 66 can come into contact with the spacer 97.

Preferably, the spacer 97 is interposed between the first and second recording heads 7 and 8 so as to become flush with the nozzle formation planes of the recording heads. As shown in FIG. 17A, when the carriage 1 is moved in the direction designated by an arrow, after the tip end of the wiping blade 66 has wiped off the nozzle formation plane of the first recording head 7, the tip end wipes away the nozzle formation plane of the second recording head 8 while remaining in contact with the spacer 97. Consequently, during the course of the wiping operation, the deformed state of the wiping blade 66 does not change at all, thus effecting a stable wiping operation.

In this case, the spacer 97 is formed from material possessing a water-absorbing characteristic. If the spacer 97 is formed from material possessing the water-absorbing characteristic, the ink wiped away from the nozzle formation plane of the first recording head 7 is absorbed by the spacer 97 by way of the wiping blade 66, so that the wiping blade 66 can properly wipe away ink from the nozzle formation plane of the second recording head 8.

As shown in FIG. 17B, an absorbing member 98 is preferably interposed between the cap units 16 and 17 sealing the nozzle formation planes of the first and second recording heads 7 and 8. In a state in which the nozzle formation planes of the recording heads are sealed, the absorbing member 98 comes into contact with the spacer 97 of the carriage 1.

By means of the foregoing configuration, the ink suctioned by the spacer 97 mounted on the carriage 1 is sequentially suctioned by the absorbing member 98 mounted on the capping device 12 from the spacer 97, while the cap units are capped by means of the capping device 12. Consequently, the amount of ink suctioned by and stored in the spacer 97 can be maintained at an appropriate level, and ink can be stably suctioned from the wiping blade 66.

In the previously-described embodiments, negative pressure is imparted to the cap units by means of two suction pumps which receive power from a single drive source and perform suction operations simultaneously. Alternatively, three or more suction pumps which perform suction operations simultaneously may also be used.

Figure 18:
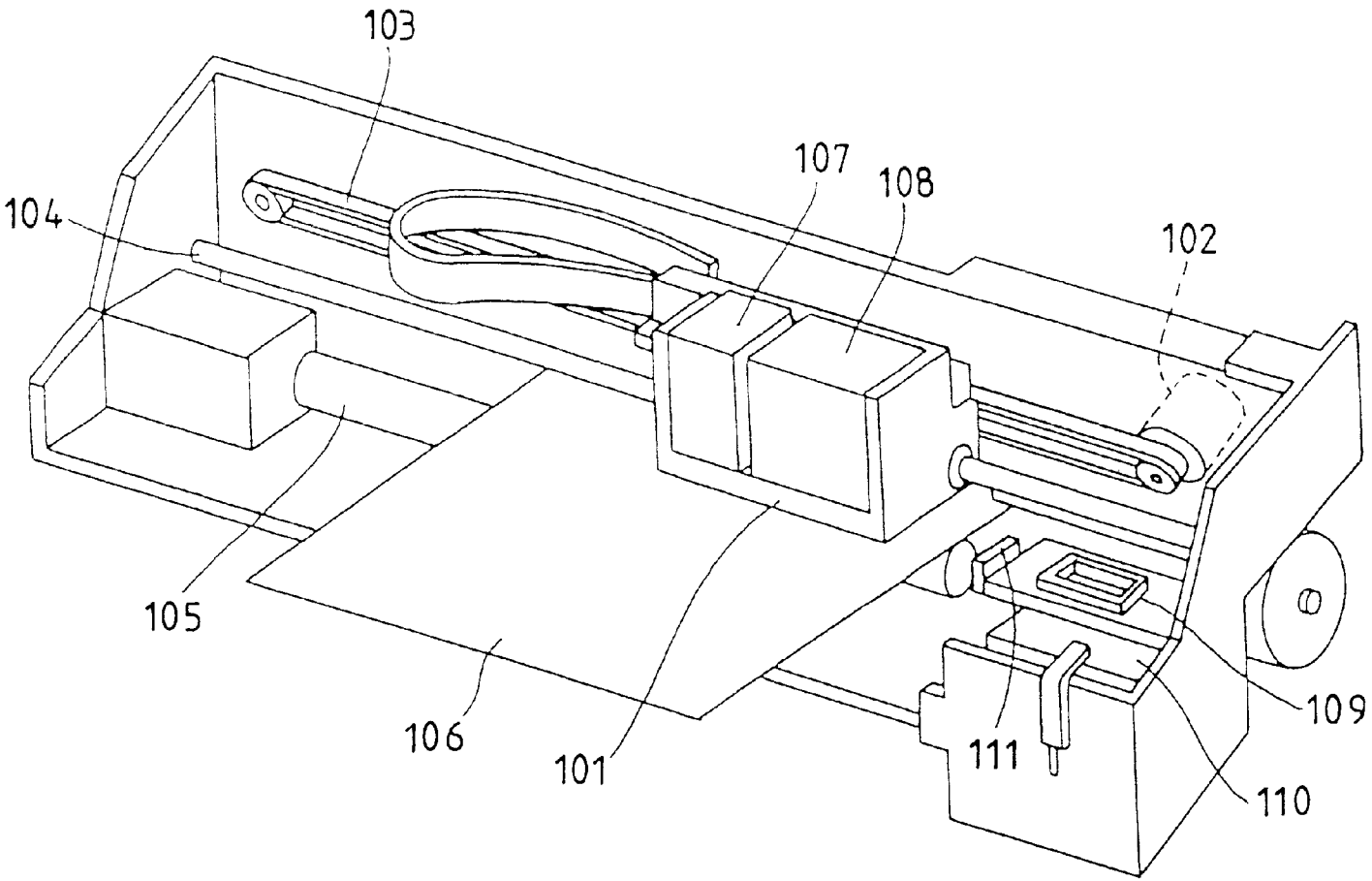
FIG. 18 is a perspective view showing the entire configuration of an ink jet recording apparatus according to a tenth embodiment of the present invention.

An explanation will now be given of an ink jet recording apparatus according to a tenth embodiment of the present invention which adopts a cleaning control method according to the present invention. In FIG. 18, a carriage 101 is guided by a guide member 104 and is moved back and forth in the axial direction of a platen 105, by way of a timing belt 103 driven by a carriage motor 102.

Although not shown in FIG. 18, an ink jet recording head is located on the area of the carriage 101 facing a recording sheet 106. A black ink cartridge 107 and a color ink cartridge 108, which serve as ink reservoirs for supplying ink to the recording head, are removably attached to the top of the ink jet recording head.

A capping device 109 is disposed at a home position (on the right side of the drawing) corresponding to a non-print area of the recording apparatus. When the recording head, which is mounted on the carriage 101 and will be described later, is moved to the home position, the capping device 109 can seal a nozzle formation plane of the recording head. A pump unit 110 is disposed below the capping device 109 for imparting negative pressure to the interior space of the capping device 109.

The capping device 109 serves as a cover for preventing nozzle orifices of the recording head from being dried while the recording apparatus is idle, serves as an ink receiver during a flushing operation during which ink droplets are ejected by application to the recording head of a drive signal irrelevant to printing, and serves as a cleaning member which discharges ink from the recording head by imparting to the recording head negative pressure from suction pumps, which will be described later and constitute the pump units 110.

A wiping blade 111 is disposed in a print area in the vicinity of the capping device 109 and is formed from an elastic plate such as rubber. For example, the wiping blade 111 is located so as to advance and recede horizontally with respect to the locus of movement of the recording head. When the carriage 101 travels back and forth toward the capping device 109, the carriage 101 can wipe away the nozzle formation plane of the recording head, as needed.

Figure 19B:
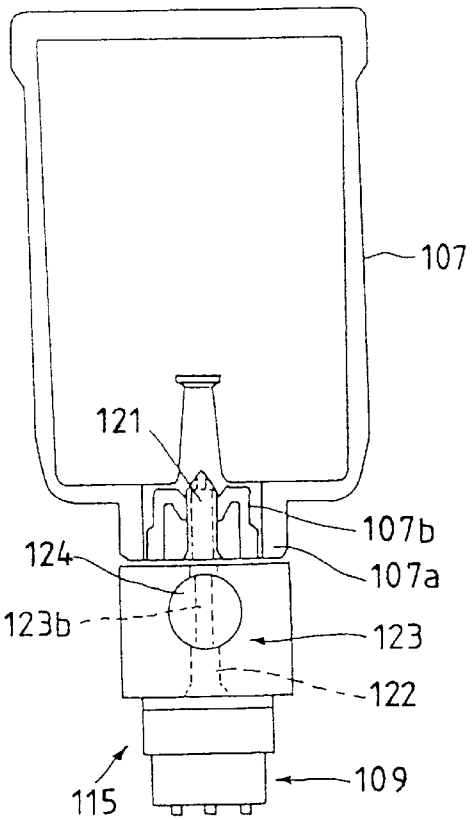
FIGS. 19A and 19B are section views showing the configuration of ink channels extending from an ink cartridge to a recording head provided in the recording apparatus shown in FIG. 18.
Figure 19A:
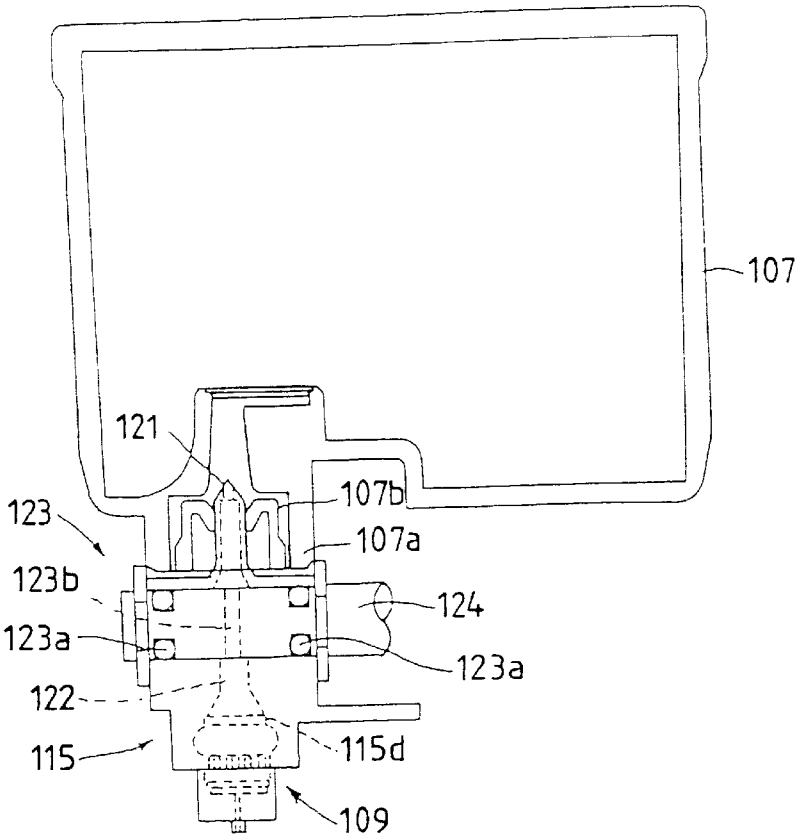

FIGS. 19A and 19B show the configuration of a valve unit interposed between the ink cartridge and the recording head in the recording apparatus shown in FIG. 18. FIGS. 19A and 19B are section views which represent views from mutually orthogonal directions. Both FIGS. 19A and 19B show a state in which the nozzle formation plane of a recording head 115 is sealed by the capping device 109 which is elevated from a lower position.

An ink cartridge 107 is usually arranged so as to be able to prevent vaporization of ink solvent, which is reserved therein by means of a film member (not shown) laminated to an ink supply port 107*a*.

When a new ink cartridge is attached to the recording head, the ink supply port 107*a* of the cartridge 107 is caused to face down toward a hollow ink supply needle 121 provided in an upright position on the reverse surface of the recording head 115. In this state, the cartridge 107 can be attached to the recording head by pushing. As a result, the ink supply needle 121 penetrates through the film laminated to the ink supply port 107*a* and is brought into close connection with a rubber seal member 107*b* provided within the ink cartridge 107, whereby ink is supplied to the recording head 115 from the ink cartridge 107.

As shown in FIGS. 19A and 19B, a valve unit 123 is disposed, as valve member for closing or opening an ink supply channel 122, in the ink supply channel 122 extending from the ink supply needle 121 to the recording head 115. The valve unit 123 is provided with a shaft 124 which is inserted so as to cross the ink supply channel 122 and which can rotate through substantially an angle of 90°. Further, airtight integrity is maintained by means of a pair of O-rings 123*a*. In the portion of the shaft 124 which crosses the ink supply channel 122, a communication hole 123*b* is formed at right angles to the shaft so as to intersect the axial direction of the shaft.

By rotation of the shaft 124 back and forth within a range of about 90° through use of an unillustrated actuator, selection is made between a valve-open state, in which the communication hole 123*b* is aligned with the ink supply channel 122, and a valve-closed state, in which the communication hole 123*b* is orthogonal to the ink supply channel 122.

A filter member 115*d* is placed in the ink supply channel 122 between the valve unit 123 and the recording head 115. As shown in the drawing, the filter member 115*d* is placed immediately below the valve unit 123, to thereby filter out foreign matter included in the ink supplied from the ink cartridge 107. Further, in the event that foreign matter is generated as a result of opening and closing action of the valve unit 123, the filter member 115*d* prevents entry of the foreign matter into the recording head 115, thus preventing print failures from arising in the recording head 115.

The valve unit 123 shown in FIGS. 19A and 19B is configured so as to open and close the ink supply channel 122 between; e.g., the black ink cartridge 107 and nozzle orifices of the recording head 115 for black ink. Similarly, a valve unit is disposed in each of the channels for supplying color inks, such as cyan ink, magenta ink, and yellow ink, from the color ink cartridge 108. Needless to say, the valve unit 123 is not limited to a specific valve such as that shown in FIGS. 19A and 19B; a valve unit of another configuration can also be used as the valve unit 123.

Figure 20:
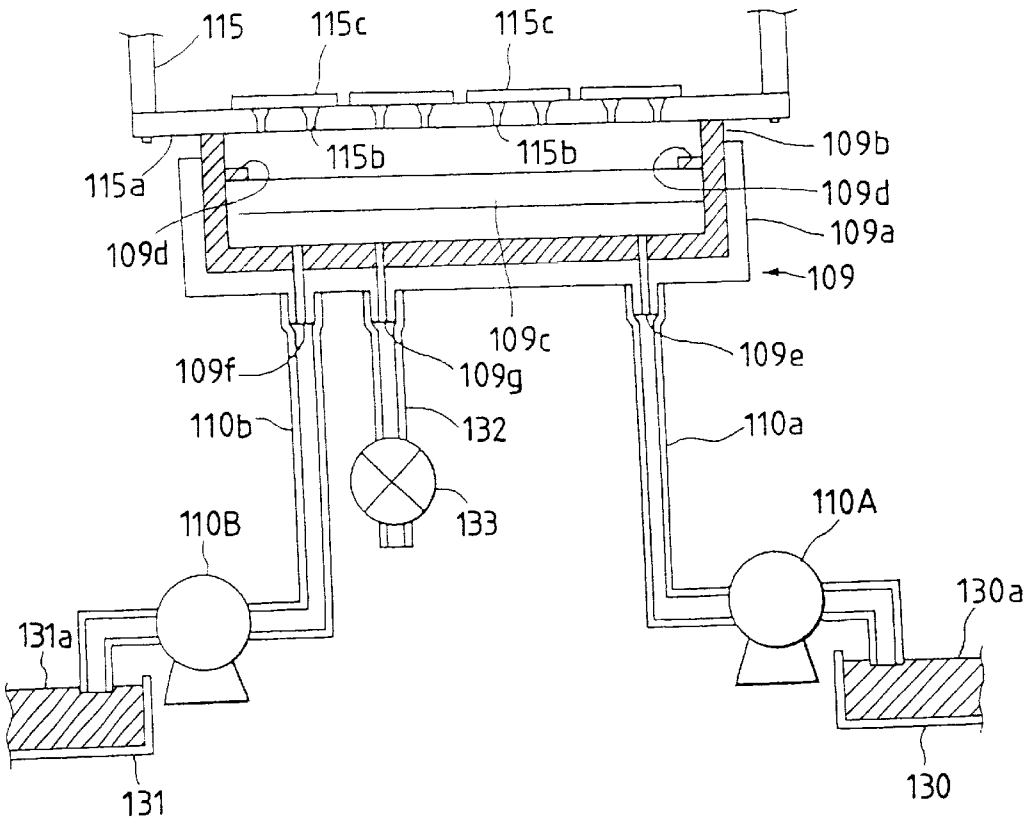
FIG. 20 is a section view showing a cap unit and suction channels in the recording apparatus shown in FIG. 18.

FIG. 20 schematically shows one example of a suction channel and an ink discharge channel, which extend from the recording head to the capping device. The capping device 109 comprises a square cap case 109*a* whose upper face is open; and a cap member 109*b* which is housed in the cap case 109*a* and is formed from a square elastic substance, such as rubber, whose upper face is open. The cap member 109*b* is formed such that the upper edge of the cap member 109*b* protrudes slightly beyond the cap case 109*a*.

An ink-absorbing member 109*c* formed from porous material is housed on the interior bottom of the cap member 109*b*. The ink-absorbing member 109*c* is retained in a retainer 109*d* integrally formed with the cap member 109*b*. Two inlets 109*e* and 109*f* and an air hole 109*g* are formed in the interior bottom of the cap case 109*a* so as to penetrate through the cap case 109*a* and the cap member 109*b*.

In the embodiment shown in FIG. 20, the two inlets 109*e* and 109*f* are spaced apart from each other in the longitudinal direction of the cap member 109*b*. The air hole 109*g* is formed at a position slightly closer to the inlet 109*f* than to the inlet 109*e*.

Reference numeral 115 shown in FIG. 20 designates the cross section of a recording head whose nozzle formation plane is sealed by the capping device 109. As mentioned previously, the recording head 115 is configured such that a nozzle plate 105*a*, which serves as the nozzle formation plane of the recording head, is capped by the cap member 109*b* when the recording head 115 is moved to a position above the capping device 109. Nozzle orifices 115*b* are formed in the nozzle plate 115*a*. Ink can be ejected from the nozzle orifices 115*b* by means of action of piezoelectric oscillators 115*c* provided so as to correspond to the respective nozzle orifices 115*b*.

A tube 110*a* is connected to the inlet 109*e* formed in the cap case 109*a*, and a tube 110*b* is connected to the inlet 109*f* formed in the same. As shown in FIG. 20, the tube 110*a* constitutes a part of a first suction pump (tube pump) constituting the pump unit 110, and the tube 110*b* constitutes a part of a second suction pump (tube pump) constituting the same. The outlet of the suction pump 110A is connected to a waste-ink tank 130 housing a waste fluid absorbing member 130*a*, and the outlet of the suction pump 110B is connected to a waste-ink tank 131 housing a waste-fluid absorbing member 131*a*.

A tube 132 is connected to the air hole 109*g* formed in the cap case 109*a*, and the air hole 109*g* is connected to an air valve 133. When the carriage 101 travels to the home position and cleaning operation is performed, the air valve 133 is configured so as to be opened or closed by means of a mechanism similar to that employed in the embodiment shown in FIG. 2, in association with movement of the carriage 101.

By means of the configuration shown in FIG. 20, negative pressure can be imparted to the interior space of the cap member 109*b* alternately or simultaneously by means of the two suction pumps 110A and 110B connected to the two inlets 109*e* and 109*f* formed in the cap case 109*a*.

Figure 21:
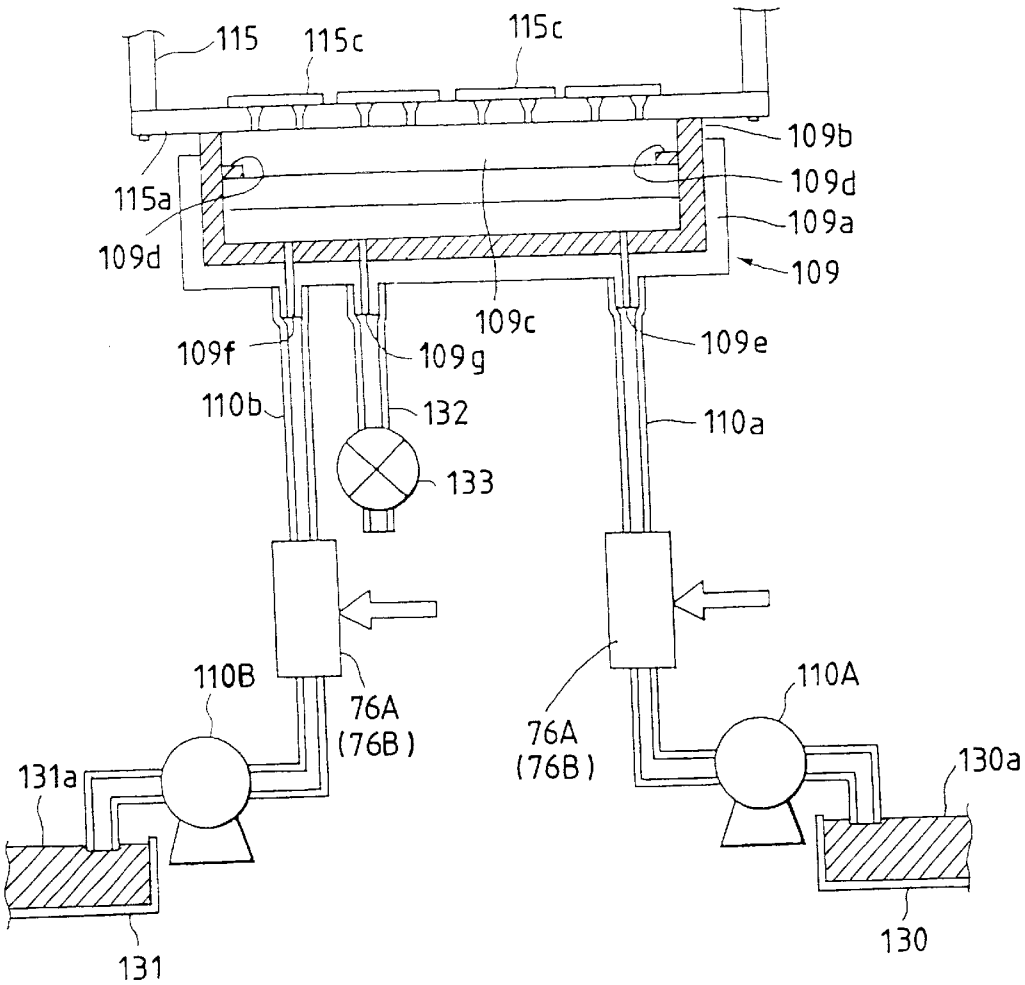
FIG. 21 is a section view showing a cap unit and suction channels in an ink jet recording apparatus according to an eleventh embodiment of the present invention.

FIG. 21 schematically shows an eleventh embodiment of the present invention, in which the suction channel and the ink discharge channel extend from the recording head and the capping device to the respective waste-ink tanks. In FIG. 21, the same reference numerals are assigned to elements corresponding to those shown in FIG. 20. The present embodiment differs from the tenth embodiment shown in FIG. 20 in that the valve member 76A capable of opening and closing a suction channel which is shown in FIG. 12, is disposed at a position along a channel between the inlet 109*e* formed in the capping member to the suction pump 110A; i.e., an intermediate position in the tube 110*a*, as well as at a position along a channel between the inlet 109*f* to the suction pump 110B; i.e., an intermediate position in the tube 110*b*. The variable flow register 76B, which is shown in FIG. 13 and is capable of changing the resistance of the suction channel, may also be placed in lieu of the valve member 76A.

In the configuration shown in FIG. 21, negative pressure can be applied to the interior space of the cap member 109*b* alternately or simultaneously by means of opening or closing the valve member 76A or by means of controlling the resistance of a flow channel through use of resistance variation means 76B.

Figure 22:
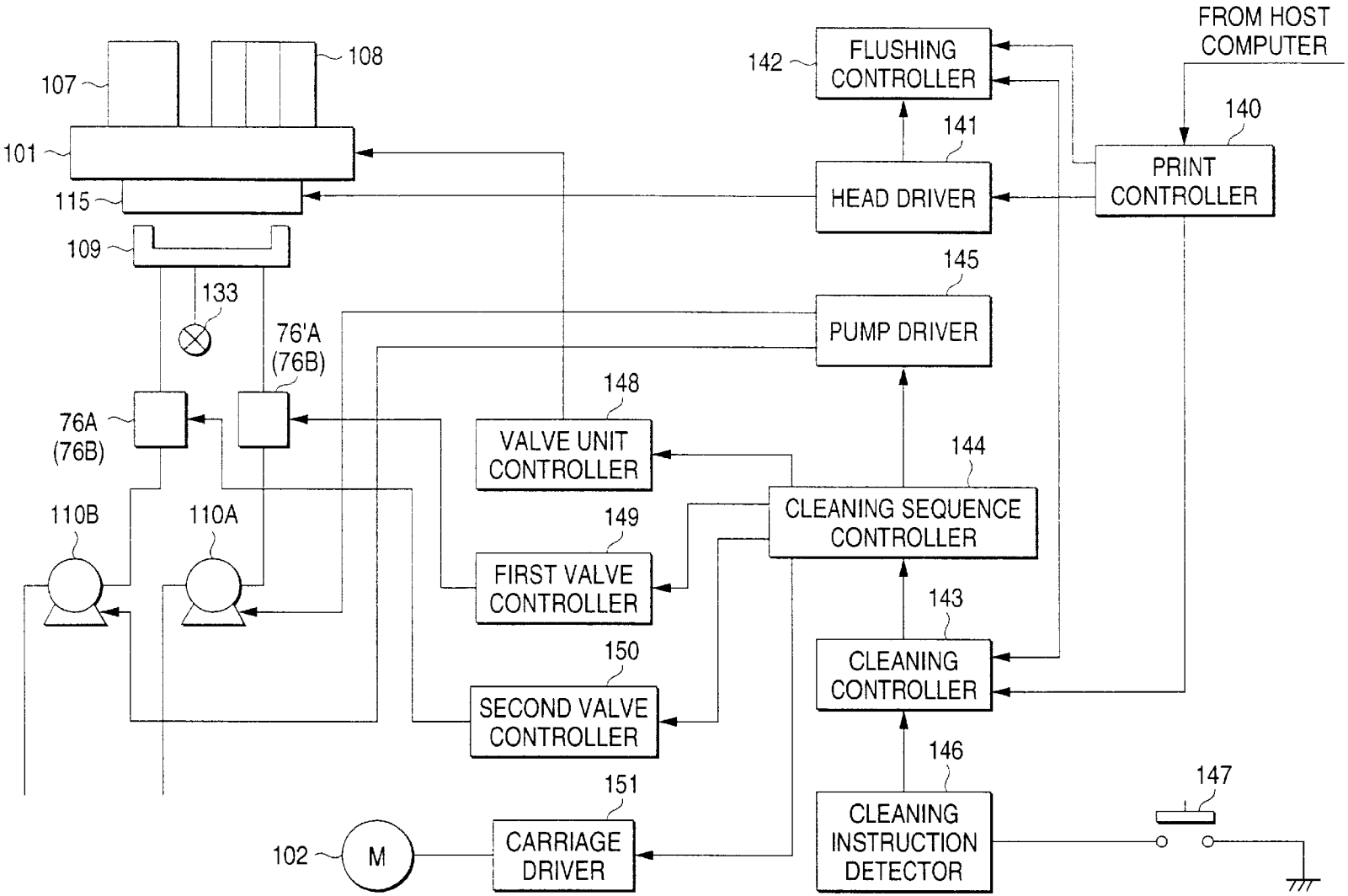
FIG. 22 is a block diagram showing an example of a control circuit provided in the recording apparatuses shown in FIG. 18.

FIG. 22 shows one example of a control circuit provided in the recording apparatus having the foregoing configuration. In FIG. 22, the same reference numerals are assigned to the carriage 101, the carriage motor 102, the ink cartridges 107 and 108, the capping device 109, the suction pumps 110A and 110B constituting the pump unit 110, the recording head 115, the air valve 133, and the two valve member 76A, which have already been described, and their detailed explanations are omitted here for brevity.

In FIG. 22, a print controller 140 generates bit-mapped data on the basis of the print data supplied from a host computer, generates a drive signal from the bit-mapped data through use of a head driver 141, and ejects ink by way of the recording head 115. The head driver 141 is also configured so as to output, in addition to the drive signal based on the print data, a drive signal for flushing operation to the recording head 115, upon receipt of a flushing instruction signal transmitted from a flushing controller 142.

A cleaning controller 143 is configured so as to supply an instruction signal to a cleaning sequence controller 144. A pump driver 145 is operated in response to the instruction signal supplied from the cleaning sequence controller 144, thereby actuating the suction pumps 110A and 110B simultaneously or selectively.

Further, the cleaning controller 143 is configured so as to receive a cleaning instruction signal transmitted from the host computer by way of the print controller 140. Moreover, the cleaning controller 143 is configured so as to receive a cleaning instruction signal transmitted from a cleaning instruction detector 146. An instruction switch 147 is connected to the cleaning instruction detector 146. For example, if the user manually depresses the instruction switch 147, the cleaning instruction detector 146 is activated, to thereby perform manual cleaning operation.

Upon receipt of an instruction signal from the cleaning controller 143, the cleaning sequence controller 144 can send control signals also to a valve unit driver 148 provided in an ink supply channel, as well as to first and second valve driver 149 and 150 provided in suction channels. In addition, the cleaning sequence controller 144 can transmit a control signal to the carriage driver 151 also.

The valve unit driver 148 sends an instruction signal to an unillustrated actuator mounted on the carriage 101, to thereby rotate the shaft 124 constituting the valve unit 123 shown in FIGS. 19A and 19B through an angle of about 90°. As a result, the valve unit 123 is opened or closed. The carriage driver 151 drives and controls the carriage motor 102 shown in FIG. 18 such that the carriage 101 is moved to; e.g., a home position and the recording head 115 is capped by the capping device 109.

In the case of the configuration according to the embodiment shown in FIG. 21, the first and second valve drivers 149 and 150 send an instruction signal to an unillustrated actuator, to thereby simultaneously or selectively (or alternately) open or close the valve member 76A or the variable flow register 76B provided in lieu of the valve member 76A.

Figure 23:
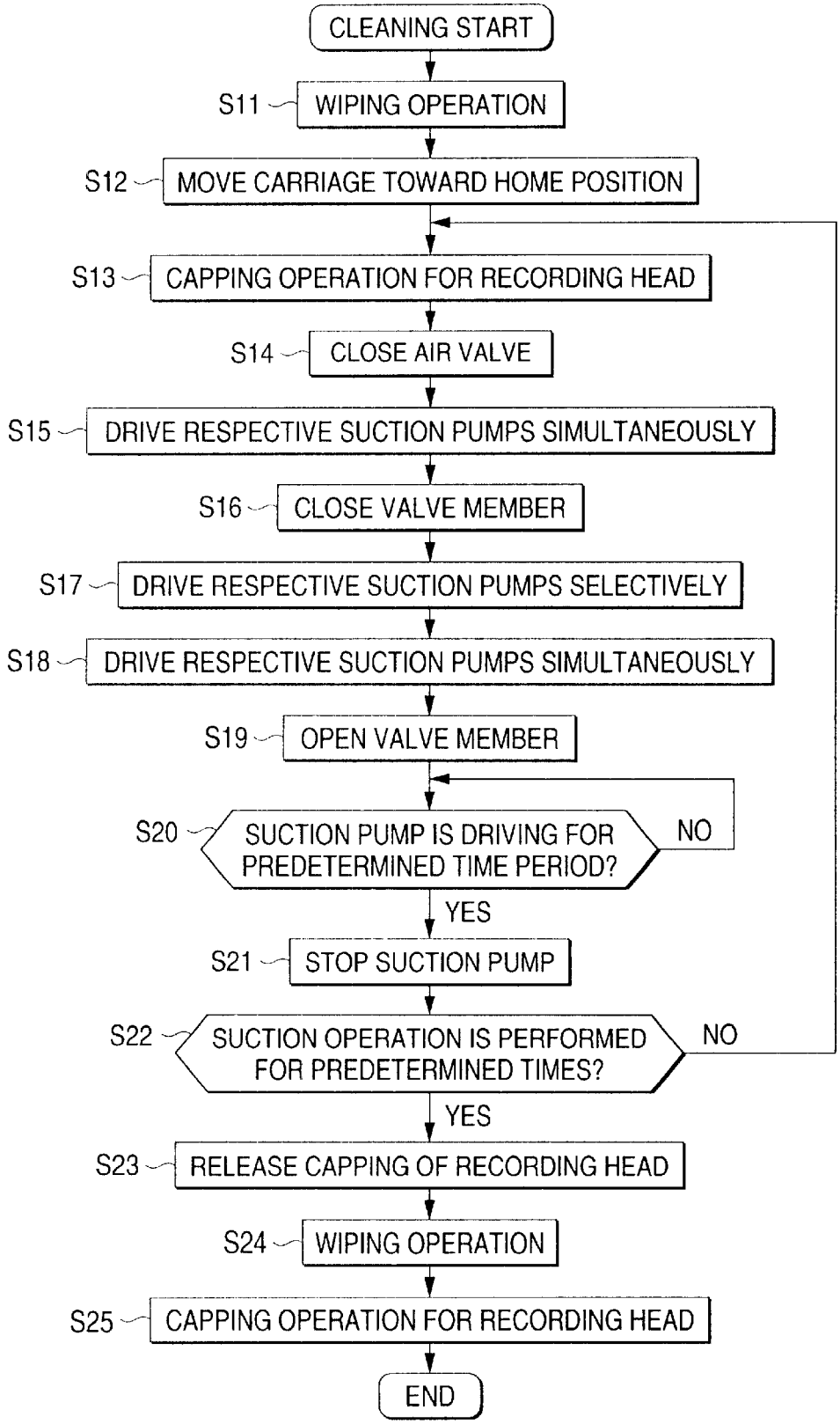
FIG. 23 is a flowchart showing a cleaning operation sequence performed by the recording apparatus shown in FIG. 20.

FIG. 23 is a flowchart showing cleaning operation of the recording head in a case where the configuration of the recording apparatus previously described is employed; particularly where there is employed the tenth embodiment using the suction channels and ink discharge channels shown in FIG. 20. The sequence of the cleaning operation will now be described by reference to FIG. 23. For example, in a case where a cleaning instruction is received on a utility of a printer driver stored in the host computer, a control signal is transmitted to the cleaning controller 143 from the host computer by way of the print controller 140, and cleaning operation is started.

As shown in step S11, when the cleaning operation is started, the nozzle formation plane of the recording head 115 is wiped away by means of the wiping blade 111. This wiping action is achieved by determination of a cleaning sequence by the cleaning controller 143; transmission of a control signal to the carriage driver 151 from the cleaning sequence controller 144 on the basis of the cleaning sequence signal; advancement of the wiping blade 111 to the travel channel of the recording head 115 during the course of movement of the carriage 101 toward the home position; and wiping of the nozzle formation plane of the recording head 115. As a result, the airtight integrity of the cap is ensured by removal of paper dust adhering to the nozzle formation plane of the recording head 115.

Next, as shown in step S12, the carriage 101 still moves toward the home position. In association with the movement of the carriage 101, the capping device 109 wipes the nozzle formation plane of the recording head 115 (S13). Simultaneously, the air valve 133 communicating with the air hole 109*g* formed in the capping device 109 is also closed (S14).

Next, the suction pumps are actuated simultaneously (S15). At this time, the valve unit 123 disposed in the ink supply channel 122 is in an open state, ink is suctioned by way of the nozzle orifices as a result of simultaneous actuation of the suction pumps, and the cap member 109*b* is filled with the thus-suctioned ink.

In this state, there are closed the valve unit 123 disposed in the black ink supply channel and the valve units 123 disposed in the respective color ink supply channels, such as a cyan ink supply channel, a magenta ink supply channel, and a yellow ink supply channel (S16). The closing action is achieved by transmission of a control signal from the cleaning sequence controller 144 shown in FIG. 22 to the valve unit controller 148.

Subsequently, the suction pumps are actuated selectively (S17). Specifically, the suction pumps 110A and 110B alternately perform suction operation in response to transmission of a control signal from the cleaning controller 143 shown in FIG. 22 to the cleaning sequence controller 144, and transmission of a control signal from the cleaning sequence controller 144 to the pump driver 145.

Negative pressure is accumulated in the interior space of the cap member 109*b* while being alternately applied to the two inlets 109*e* and 109*f*, which are formed so as to be spaced apart from each other in the lower bottom of the cap case 109*a* shown in FIG. 20. Through such suction operation, negative pressure is alternately applied to the clogged nozzle orifices of the recording head 115 in different directions, thus imparting vibration to the solid ink present in the nozzle orifices. Alternatively, a flow which vibrates the ink stored in the cap member 109*b* arises, and ink actively comes into contact with the clogged nozzle orifices, thereby enabling promotion of softening or dissolution of ink solids.

Next, the suction pumps are actuated simultaneously (S18). Through the simultaneous actuation of the suction pumps, further negative pressure is accumulated in the interior space of the cap member 109*b*. In this state, the valve units 123 are opened (S19). As shown in FIG. 22, the opening of the valve units 123 is achieved by transmission of a control signal from the sequence controller 144 to the valve unit driver 148.

A fast ink flow can be momentarily caused in the ink channel extending from the ink cartridge 107 to the recording head 115, by means of the valve unit 123 being opened in step S19. Consequently, the solids that have already undergone vibration or which are in a softened state can be readily removed from the nozzle orifices by virtue of the fast ink flow. Further, the air bubbles present within the ink channels can also be removed by means of the fast ink flow, thus recovering the functions of the recording head.

Subsequently, a determination is made as to whether or not the suction pump has been actuated for a predetermined period of time (S20). By means of opening of the valve unit 123 in step S19, ink is discharged into the capping device 109. Through subsequent continuous actuation of the suction pumps, the ink discharged to the capping device 109 is immediately emitted to the waste-ink tanks 130 and 131.

Through the foregoing discharging operation, there can be effectively prevented a print failure or mixing of colors, which would otherwise be caused when ink froths up within the capping device 109 and by entry of ink into the nozzle orifices under negative pressure.

In step S20, if a predetermined period of time is determined to have elapsed, the actuation of the pumps is stopped (S21). Subsequently, a determination is made as to whether or not the suction of ink has been performed a predetermined number of times (S22). If the number of times is less than the predetermined number of times, processing pertaining to steps S13 through S21 are repeated.

In step S22, a determination is made that ink has been suctioned a predetermined number of times, the recording head is released from a capped state (S23). Subsequently, as shown in step S24, wiping operation is performed, to thereby wipe away ink adhering to the nozzle formation plane of the recording head, by means of the wiping blade 111. In step S25, the recording head 115 is again capped by means of the capping device 109 and awaits arrival of print data.

Although a determination is made, according to the sequence shown in FIG. 23, as to whether or not ink has been suctioned a predetermined number of times in step S22, there is no need to repeat suction operation a predetermined number of times, so long as a sufficient cleaning result is obtained through a single ink suction operation.

Although, according to the sequence shown in FIG. 23, the suction pumps are selectively actuated in step S17 and the suction pumps are simultaneously actuated in step S18, the same operation and working effects are achieved even if steps S17 and S18 are interchanged.

Negative pressure can be quickly accumulated in the interior space of the cap member 109*b* by simultaneous actuation of the suction pumps 110A and 110B while the valve unit 123 is closed. The suction pumps are selectively actuated in this state, to thereby impart vibration to solids adhering to the nozzle orifices under large negative pressure. Accordingly, removal of solids accumulated on the nozzle orifices is promoted.

Figure 24:
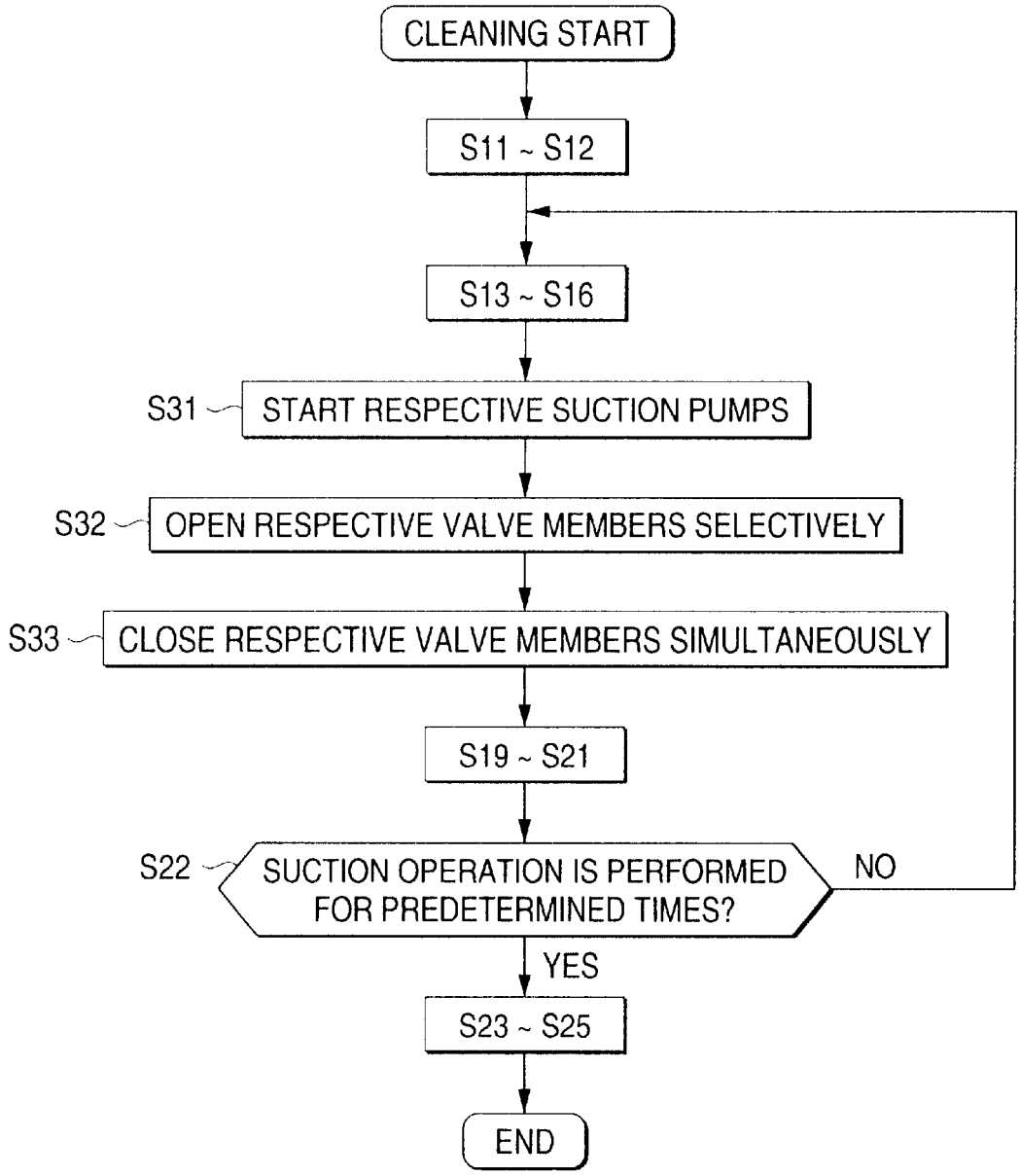
FIG. 24 is a flowchart showing a cleaning operation sequence performed by the recording apparatus shown in FIG. 21.

FIG. 24 is a flowchart showing the cleaning operation of the recording head in the case of employment of the eleventh embodiment provided with the suction and ink discharge channels shown in FIG. 21. As mentioned previously, in the embodiment shown in FIG. 21, the valve member 76A or the variable flow register 76B provided in lieu thereof is disposed in each of the suction channels extending from the inlets 109*e* and 109*f* formed in the capping member to the respective suction pumps 110A and 110B. Operation, which is the same as that performed when the suction pumps 110A and 110B are alternately actuated, can be achieved by opening or closing the valve member 76A or the variable flow register 76B provided in lieu thereof while the suction pumps 110A and 110B are held in suction operation.

FIG. 24 shows a cleaning sequence executed through the foregoing operation. Control operations relating to steps S17 and S18 in the sequence shown in FIG. 23 are replaced by those relating to steps S31 through S33 shown in FIG. 24.

More specifically, after the valve unit 123 has been closed in step S16, simultaneous actuation of the suction pumps is commenced in step S31. In step S32, the valve member 76A or the variable flow register 76B provided in lieu thereof, which is disposed in each of the suction channels, is opened or closed immediately. The opening or closing action is achieved by transmission of a control signal to the first and second valve driver 149 and 150, by means of the cleaning sequence controller 144 shown in FIG. 22.

The operation, which is the same as that performed when the suction pumps 110A and 110B alternately perform suction operation, is achieved by the foregoing operations. As a result, negative pressure is accumulated in the interior space of the cap member 109*b* while negative pressure alternately acts on the two inlets 109*e* and 109*g*. As mentioned previously, negative pressure alternately acts on the clogged nozzle orifices of the recording head 115 in different directions, thus imparting vibration to ink solids adhering to the nozzle orifices.

Subsequently, the valve member 76A or the variable flow register 76B provided in lieu thereof are all closed (S33). The closing action is also achieved by transmission of a control signal to the first and second valve driver 149 and 150 from the sequence controller 144.

As a result, the operation, which is the same as that performed when the suction pumps 110A and 110B simultaneously perform suction operation, is achieved, and negative pressure is further accumulated in the interior space of the cap member 109*b*. In this state, processing proceeds to step S19. A fast ink flow instantaneously arises in the ink channel extending from the ink cartridge 107 to the recording head 115 by opening of the valve unit 123. As in the case of the previously-described operation, the solids that have undergone vibration or that are in a softened state can be readily removed from nozzle orifices. Further, air bubbles present in the ink channel can also be removed by means of a fast ink flow, thus recovering the functions of the recording head.

The same operation and working effects can be achieved even when steps S32 and S33 shown in FIG. 24 are interchanged. Specifically, the valve member 76A or the variable flow register 76B provided in lieu thereof are opened, to thereby quickly accumulate negative pressure in the interior space of the cap member 109*b*. Subsequently, the valve member 76A or the variable flow register 76B provided in lieu thereof are selectively opened, and vibration is imparted to the solids adhering to the nozzle orifices under great negative pressure, thus enabling promotion of removal of the solids accumulated on the nozzle orifices.

In the embodiment shown in FIG. 21, the valve member 76A or the variable flow register 76B provided in lieu thereof is disposed in each of the tubes 110*a* and 110*b*, which constitute the suction channels. Even if one valve member is disposed in at least one of the suction channels, vibration, which may not necessarily be sufficient, can be imparted to the solids adhering to the nozzle orifices.

The previous description of the cleaning operation is based on a case where the valve units 123 disposed in the black ink supply channel and the color ink supply channels, such as a cyan ink supply channel, a magenta ink supply channel, and a yellow ink supply channel, are simultaneously opened upon receipt of a control signal from the valve unit controller 148. There may. also be employed controller which opens a valve unit disposed in a channel for supplying ink which is most susceptible to an increase in viscosity; for example, a black ink supply channel, and opens and closes the valve units 123 disposed in the other color ink supply channels according to the previously-described sequence. By means of such a control sequence, the valve unit disposed in the black ink supply channel is opened, to thereby enable active discharge of black ink susceptible to an increase in viscosity.

Even in a case where there is effected control operation for maintaining in an open state only the valve unit disposed in the channel for supplying ink most susceptible to an increase in viscosity; for example, a black ink supply channel, the same operation and working effects can be achieved even when steps S17 and S18 shown in FIG. 23 are interchanged. As described in connection with FIG. 24, the controller can be employed in the same manner as in the previous descriptions, even in a case where the valve member 76A or the variable flow register 76B provided in lieu thereof, which are disposed in the suction channels, are opened or closed.

In the embodiments shown in FIGS. 20 and 21, the two inlets 109*e* and 109*f* are formed so as to be spaced apart from each other in the longitudinal direction of the cap case 109*a*. Preferably, as shown in FIGS. 25A and 25B, in a state in which the nozzle formation plane of the recording head is sealed by the capping member, inlets are formed so as to be spaced apart from each other in the areas of the bottom of the capping member corresponding to both ends of the row of nozzles which eject ink most susceptible to an increase in viscosity.

Figure 25A:
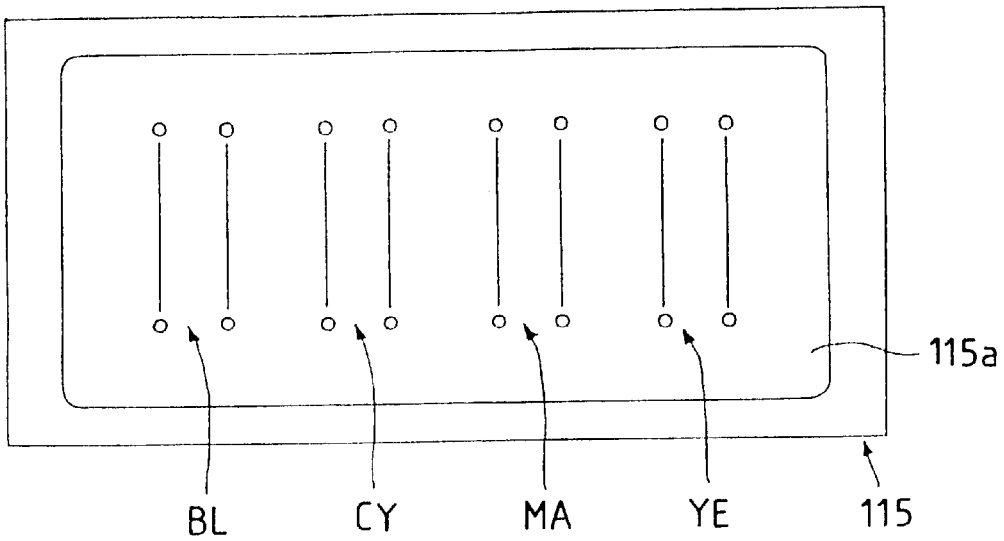
FIGS. 25A and 25B is a perspective view and a plan view respectively showing a cap unit in an ink jet recording apparatus according to a twelfth embodiment of the present invention.

More specifically, FIG. 25A shows a perspective view of the recording head 115 sealed by the capping device 109. In the nozzle formation plane 115*a* of the recording head 115, there are formed in sequence from the left a pair of BL nozzles for ejecting black ink, a pair of CY nozzles for ejecting cyan ink, a pair of MA nozzles for ejecting magenta ink, and a pair of YE nozzles for ejecting yellow ink.

Figure 25B:
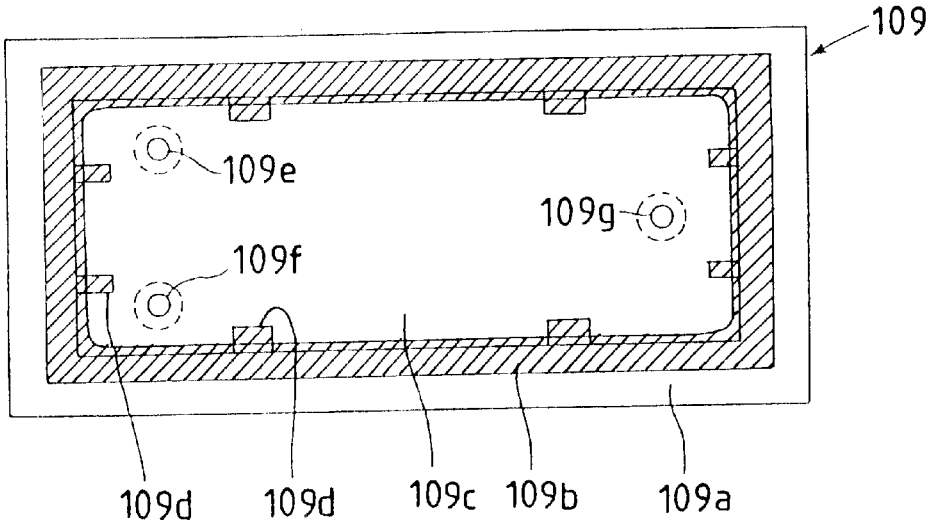

FIG. 25B shows, in plan view, the configuration of the capping device 109 which seals the nozzle formation plane 115*a* from below. The two inlets 109*e* and 109*f* are formed so as to be spaced apart from each other at the positions on the bottom of the capping device 109 corresponding to both ends of the row of nozzles for ejecting ink most susceptible to an increase in viscosity; for example, the row of nozzles BL for ejecting black ink.

In the configuration shown in FIG. 25, when the two inlets 109*e* and 109*f* are alternately suctioned, vibration can be effectively imparted to both ends of the row of BL nozzles for ejecting black ink, which are most susceptible to an increase in viscosity, thus effectively removing clogging caused by black ink.

Preferably, as shown in FIG. 25B, the air hole 109*g* is formed in the longitudinal end of the cap unit opposite the end where the inlets 109*e* and 109*f* are formed. With such an arrangement of the inlets and the air hole, ink can flow orderly within the cap unit when ink is discharged from the interior of the cap unit, thus enabling thorough wiping of ink from the interior of the cap unit.

Although in the previous embodiment the two inlets 109*e* and 109*f* are formed in the capping device 109, three or more inlets may be formed and sucked by means of corresponding suction pumps. In this case, for example, a tube pump is used as the suction pump, and the drive shafts of the tube pumps are connected in tandem, thereby realizing a suction pump unit without an increase in the area occupied by the pumps. In contrast with limitations imposed on the case where the radius of the circular-arch pattern of the tube is increased for the purpose of increasing the suction capability of the tube pump, limitations imposed on the layout of the pumps are much less restrictive. The entire recording apparatus can be made compact while the suction capability of the pumps is increased.

Further, although the previous embodiments describe the on-carriage type recording apparatus whose ink cartridges serving as ink reservoirs are mounted on a carriage, it goes without saying that the present invention can also be applied to a recording apparatus whose sub-tanks serving as ink reservoirs are placed on a carriage, as shown in FIG. 1, and are refilled with inks from ink cartridges (or main ink tanks) provided in a portion of the recording apparatus by way of; e.g., tubes.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

at least one recording head having a face on which a plurality of nozzle orifices are formed, the recording head mounted on a carriage to be moved reciprocatively in the widthwise direction of a recording sheet;

a capping device disposed in a non-print region of the recording head, the capping device including at least one cap unit for sealing the nozzle-formed surface of the recording head in cooperation with the movement of carriage; and a plurality of suction pumps for applying negative pressure in the interior space of the cap unit via connecting members while the cap unit seals the nozzle-formed surface in cooperation with at least one drive source, wherein the number of the suction pumps is greater than the number of the at least one cap unit.

2. The ink jet recording apparatus as set forth in claim 1, wherein a first recording head and a second recording head are mounted on the carriage, wherein the capping device includes a first cap unit and a second cap unit provided for the first recording head and the second recording head respectively, and wherein the plural suction pumps include a first suction pump and a second suction pump that apply negative pressure with respect to the first and second cap units respectively.

3. The ink jet recording apparatus as set forth in claim 2, wherein the respective suction pumps cooperate with a single drive source.

4. The ink jet recording apparatus as set forth in claim 2, wherein the connecting members include a first connecting member for connecting the first cap unit and the first suction pump and a second connecting member for connecting the second cap unit and the second suction pump, which are different from each other in length.

5. The ink jet recording apparatus as set forth in claim 2, wherein the connecting members include a first connecting member for connecting the first cap unit and the first suction pump and a second connecting member for connecting the second cap unit and the second suction pump, which are different from each other in inner diameter.

6. The ink jet recording apparatus as set forth in claim 2, further comprising:

an elastic wiping blade abutted against the nozzle-formed faces of the first and second recording heads for wiping away ink adhering thereto; and a spacer disposed between the first and second recording head so as to be touched by the wiping blade.

7. The ink jet recording apparatus as set forth in claim 6, wherein the spacer is made of a water-absorbing material.

8. The ink jet recording apparatus as set forth in claim 7, further comprising:

an absorber made of a water-absorbing material, and disposed between the first and second cap units so as to be brought into contact with the spacer while the nozzle-formed faces of the first and second recording heads are sealed by the first and second cap units.

9. The ink jet recording apparatus as set forth in claim 1, wherein the cap unit includes a plurality of suction ports respectively communicating with the interior space thereof and connected to the respective suction pumps via the connecting members, and wherein the respective suction pumps perform the suction operation simultaneously.

10. The ink jet recording apparatus as set forth in claim 9, wherein the suction ports are formed on an inner bottom portion of the cap unit and at one end portion in the longitudinal direction thereof.

11. The ink jet recording apparatus as set forth in claim 10, wherein an air hole is formed on an inner bottom portion of the cap unit and at the other end portion in the longitudinal direction thereof.

12. The ink jet recording apparatus as set forth in claim 9, wherein the suction ports are arranged closely to one another.

13. The ink jet recording apparatus as set forth in claim 9, wherein a valve member is provided in at least one of the connecting members for opening/closing the same.

14. The ink jet recording apparatus as set forth in claim 9, wherein a variable flow resistor is provided in at least one of the connecting members for varying flow resistance thereof.

15. The ink jet recording apparatus as set forth in claim 1, wherein the capping device includes a plurality of cap units, wherein each of the cap units includes a suction port communicating with the respective interior space thereof, and wherein each of the connecting members connected to the respective suction ports has a junction portion for combining tubes connected to the respective suction pumps which perform the suction operation simultaneously.

16. The ink jet recording apparatus as set forth in claim 1, wherein the capping device includes a plurality of cap units, wherein each of the cap units includes a suction port communicating with the respective interior space thereof, and wherein the connecting members include a first junction portion for combining subtubes connected to the respective suction ports and a second junction portion connected to the first junction portion for combining subtubes connected to the respective suction pumps which perform the suction operation simultaneously.

17. The ink jet recording apparatus as set forth in claim 16, wherein the subtubes connected to the respective suction ports are different from each other in length.

18. The ink jet recording apparatus as set forth in claim 16, wherein the subtubes connected to the respective suction ports are different from each other in inner diameter.

19. The ink jet recording apparatus as set forth in claim 16, wherein the subtubes connected to the respective suction ports and the tubes connected to the respective suction pumps are made of different materials.

20. The ink jet recording apparatus as set forth in claim 19, wherein the subtubes connected to the respective suction ports are made of a material having high gas-barrier characteristic.

21. The ink jet recording apparatus as set forth in claim 16, wherein a valve member is provided in at least one of the subtubes connected to the respective suction ports for opening/closing the same.

22. The ink jet recording apparatus as set forth in claim 21, wherein the subtube in which the valve member is provided is connected to a cap unit for sealing a recording head having relatively smaller number of nozzle orifices.

23. The ink jet recording apparatus as set forth in claim 21, wherein the subtube in which the valve member is provided is connected to a cap unit for sealing a recording head for ejecting ink most susceptible to an increase in viscosity.

24. The ink jet recording apparatus as set forth in claim 16, wherein a variable flow resistor is provided in at least one of the subtubes connected to the respective suction ports for varying flow resistance thereof.

25. The ink jet recording apparatus as set forth in claim 24, wherein the subtube in which the variable flow resistor is provided is connected to a cap unit for sealing a recording head having relatively smaller number of nozzle orifices.

26. The ink jet recording apparatus as set forth in claim 24, wherein the subtube in which the variable flow resistor is provided is connected to a cap unit for sealing a recording head for ejecting ink most susceptible to an increase in viscosity.

27. The ink jet recording apparatus as set forth in claim 15 or 16, wherein the subtubes connected to the respective suction pumps are substantially the same in length.

28. The ink jet recording apparatus as set forth in claim 15 or 16, wherein the subtubes connected to the respective suction pumps are different from each other in length.

29. The ink jet recording apparatus as set forth in claim 15 or 16, wherein the subtubes connected to the respective suction pumps are different from each other in inner diameter.

30. The ink jet recording apparatus as set forth in claim 15 or 16, wherein a valve member is provided in at least one of the subtubes connected to the respective suction pumps for opening/closing the same.

31. The ink jet recording apparatus as set forth in claim 15 or 16, wherein a variable flow resistor is provided in at least one of the subtubes connected to the respective suction pumps for varying flow resistance thereof.

32. The ink jet recording apparatus as set forth in claim 17 or 4, wherein the recording head, which is sealed by the cap unit having the shorter connecting member, has a larger number of the nozzle orifices.

33. The ink jet recording apparatus as set forth in claim 17 or 4, wherein the recording head, which is sealed by the cap unit the having thicker connecting member, has a larger number of the nozzle orifices.

34. The ink jet recording apparatus as set forth in claim 1, wherein each of the suction pumps includes:

a frame body having a semicircular support face for supporting one of the connecting members therealong;

a wheel body rotated by the drive source in the frame body; and a plurality of rollers rotatably provided on the wheel body for squeezing the connecting members supported on the support surface, wherein the rollers squeeze the connecting members so as to become out of phase in the rotation direction of the wheel body with one another from the suction pump to the suction pump.

35. The ink jet recording apparatus as set forth in claim 34, wherein the plural suction pumps are composed of a first suction pump and a second suction pump, wherein the frame bodies of the first and second suction pumps are attached with each other such that a central axis of the wheel bodies are made coincident with each other, and wherein the rollers squeeze the connecting members so as to be 90° out of phase in the rotation direction of the wheel body with one another from the first suction pump to the second suction pump.

36. The ink jet recording apparatus as set forth in claim 34, wherein outlets of the plural suction pumps are lead to different waste-ink tanks.

37.The ink jet recording apparatus as set forth in claim 36, further comprising: means for counting the amount of ink flowing into the waste-ink tanks.

38. The ink jet recording apparatus as set forth in claim 37, wherein the counting means counts accumulately the amount of ink by selectively use of parameters specified according to respective ink suction operation modes.

39. The ink jet recording apparatus as set forth in claim 38, further comprising: means for indicating whether the amount of ink counted by the counting means reaches for a predetermined value.

40. The ink jet recording apparatus as set forth in claim 38, further comprising: means for deactivating the apparatus when the amount of ink counted by the counting means reaches for a predetermined value.

41. The ink jet recording apparatus as set forth in claim 37, wherein the counting means is provided for each of the waste-ink tanks.

42. The ink jet recording apparatus as set forth in claim 36, wherein waste fluid absorbing members disposed in the respective waste-ink tanks are substantially the same in size.

43. The ink jet recording apparatus as set forth in claim 36, wherein waste fluid absorbing members disposed in the respective waste-ink tanks are different from each other in size.

44. The ink jet recording apparatus as set forth in claim 1, further comprising:

an ink reservoir for supplying ink to the recording head via a channel;

a valve member provided in the channel, the valve member opened when the negative pressure is sufficiently accumulated within the interior space of the cap unit;

at least two suction ports formed on the cap unit so as to be spaced apart from each other and connected to the respective suction pumps via the connecting members; and control means for opening/closing the valve member and for driving the suction pumps either selectively or simultaneously.

45. The ink jet recording apparatus as set forth in claim 44, comprises a plurality of ink reservoirs, channels and valve members.

46. A cleaning control method performed by an ink jet recording apparatus as set forth in claim 44, comprising the steps of:

a) opening the valve members;

b) driving the suction pumps simultaneously;

c) closing valve members other than a valve member for a row of nozzle orifices for ejecting ink most susceptible to an increase in viscosity;

d) driving the suction pumps selectively;

e) driving the suction pumps simultaneously; and f) opening the closed valve members, wherein the steps a) to f) are performed in this order.

47. A cleaning control method performed by an ink jet recording apparatus as set forth in claim 45, comprising the steps of:

a) opening the valve members;

b) driving the suction pumps simultaneously;

c) closing valve members other than a valve member for a row of nozzle orifices for ejecting ink most susceptible to an increase in viscosity;

d) driving the suction pumps simultaneously;

e) driving the suction pumps selectively; and f) opening the closed valve members, wherein the steps a) to f) are performed in this order.

48. A cleaning control method performed by an ink jet recording apparatus as set forth in claim 44, comprising the steps of:

a) opening the valve member b) driving the suction pumps simultaneously;

c) closing the valve member:

d) driving the suction pumps selectively:

e) driving the suction pumps simultaneously; and f) opening the valve member, wherein the steps a) to f) are performed in this order.

49. A cleaning control method performed by an ink jet recording apparatus as set forth in claim 44, comprising the steps of:

a) opening the valve member;

b) driving the suction pumps simultaneously;

c) closing the valve member;

d) driving the suction pumps simultaneously;

e) driving the suction pumps selectively; and f) opening the valve member, wherein the steps a) to f) are performed in this order.

50. The ink jet recording apparatus as set forth in claim 1, further comprising:

an ink reservoir for supplying ink to the recording head via a channel;

a first valve member provided in the channel, the valve member opened when the negative pressure is sufficiently accumulated within the interior space of the cap unit;

at least two suction ports formed on the cap unit so as to be spaced apart from each other and connected to the respective suction pumps via the connecting members;

a second valve member provided in at least one of the connecting members; and control means for opening/closing the second valve member and for simultaneously driving the suction pumps while the first valve member is closed.

51. The cleaning control apparatus as set forth in claim 44 or 50, wherein the suction ports are formed on a bottom face of the cap unit so as to be situated at both ends of a row of nozzle orifices for jetting ink most susceptible to an increase in viscosity while the nozzle-formed face of the recording head is sealed by the cap unit.

52. The cleaning control method as set forth in any of claims 48 to 47, wherein the driving step of the suction pumps is continued for a predetermined time period even after the final step of opening the valve members.

53. The ink jet recording apparatus as set forth in claim 17 or 4, wherein the recording head for ejecting ink most susceptible to an increase in viscosity is sealed by the cap unit having a shorter connecting member.

54. The ink jet recording apparatus as set forth in claim 17 or 4, wherein the recording head for ejecting ink most susceptible to an increase in viscosity is sealed by the cap unit having a thicker connecting member.

55. The ink jet recording apparatus as set forth in claim 1, wherein the connecting member is a suction tube.

56. A cleaning control method comprising the steps of:

providing an ink jet recording apparatus which comprises:

a first recording head and a second recording head respectively having a face on which a plurality of nozzle orifices are formed, the recording head mounted on a carriage to be moved reciprocatively in the widthwise direction of a recording sheet;

a capping device disposed in a non-print region of the recording head, the capping device including at least one cap unit for sealing the nozzle-formed surface of the recording head in cooperation with the movement of carriage;

a plurality of suction pumps for applying negative pressure in the interior space of the cap unit via connecting members while the cap unit seals the nozzle-formed surface in cooperation with at least one drive source; and an elastic wiping blade abutted against the nozzle-formed faces of the first and second recording heads for wiping away ink adhering thereto;

moving the carriage such that the wiping blade wipes away ink adhering to the nozzle-formed face of the first recording head;

stopping the carriage at a position where the wiping blade is situated between the first recording head and the second recording head;

waiting for the wiping blade to elastically restore to original state thereof; and moving the carriage so the wiping blade wipes away ink adhering to the nozzle-formed face of the second recording head.

57. An ink jet recording apparatus comprising:

a plurality of recording heads each having a face on which a plurality of nozzle orifices are formed, the recording heads mounted on a carriage to be moved reciprocatively in the widthwise direction of a recording sheet;

a capping device disposed in a non-print region of the recording head, the capping device including a plurality of cap units each for sealing the nozzle-formed surface of the associated recording head in cooperation with the movement of carriage;

a plurality of suction pumps each for applying negative pressure in the interior space of the associated cap unit via connecting members while the associated cap unit seals the associated nozzle-formed surface in cooperation with at least one drive source;

a junction provided between the cap units and the suction pumps so as to integrate parts of the connecting members; and a resistance member provided on at least one connecting member which is situated between the junction and the associated cap unit, the resistance member varying a flow resistance of the associated connection member.

58. The ink jet recording apparatus as set forth in claim 57, wherein each of the suction pumps includes:

a frame body having a semicircular support face for supporting one of the connecting members therealong;

a wheel body rotated by the drive source in the frame body; and a plurality of rollers rotatably provided on the wheel body for squeezing the connecting member supported on the support surface, wherein the rollers squeeze the connecting members so as to become out of phase in the rotation direction of the wheel body with one another from the suction pump to the suction pump.

59. The ink jet recording apparatus as set forth in claim 58, wherein the plural suction pumps are composed of a first suction pump and a second suction pump, wherein the frame bodies of the first and second suction pumps are attached with each other so as to the central axis of the wheel bodies are made coincident with each other and, wherein the rollers squeeze the connecting members so as to be 90° out of phase in the rotation direction of the wheel body with one another from the first suction pump to the second suction pump.

60. The ink jet recording apparatus as set forth in claim 58, wherein outlets of the plural suction pumps are lead to different waste-ink tanks.

61. The ink jet recording apparatus as set forth in claim 60, further comprising: means for counting the amount of ink flowing into the waste-ink tanks.

62. The ink jet recording apparatus as set forth in claim 61, wherein the counting means counts accumulately the amount of ink by selectively use of parameters specified according to respective ink suction operation modes.

63. The ink jet recording apparatus as set forth in claim 62, further comprising: means for indicating whether the amount of ink counted by the counting means reaches for a predetermined value.

64. The ink jet recording apparatus as set forth in claim 61, wherein the counting means is provided for each of the waste-ink tanks.

65. The ink jet recording apparatus as set forth in claim 60, wherein waste fluid absorbing members disposed in the respective waste-ink tanks are substantially the same in size.

66. The ink jet recording apparatus as set forth in claim 60, wherein waste fluid absorbing members disposed in the respective waste-ink tanks are different from each other in size.

67. The ink jet recording apparatus as set forth in claim 57, wherein the connecting member is a suction tube.

68. The ink jet recording apparatus as set forth in claim 57, wherein the resistance member is provided as a value member.

69. The ink jet recording apparatus as set forth in claim 57, wherein the resistance member is provided as a variable flow resistor.

70. The ink jet recording apparatus as set forth in claim 57, wherein the respective suction pumps perform the suction operation simultaneously.

71. An ink jet recording apparatus:

a plurality of recording heads each having a face on which a plurality of nozzle orifices are formed, the recording heads mounted on a carriage to be moved reciprocatively in the widthwise direction of a recording sheet;

a capping device disposed in a non-print region of the recording head, the capping device including a plurality of cap units each for sealing the nozzle-formed surface of the associated recording head in cooperation with the movement of carriage;

a plurality of suction pumps each for applying negative pressure in the interior space of the associated cap unit via connecting members while the associated cap unit seals the associated nozzle-formed surface in cooperation with at least one drive source;

wherein each of the suction pumps include:

a frame body having a semicircular support face for supporting one of the connecting members there along;

a wheel body rotated by the drive source in the frame body; and a plurality of rollers rotatably provided on the wheel body for squeezing the connecting member supported on the support surface, wherein the rollers squeeze the connecting members so as to become out of phase in the rotation direction fo the wheel body with one another from the suction pump to the suction pump;

wherein the plural suction pumps are composed of a first suction pump and a second suction pump, wherein the frame bodies of the first and second suction pumps are attached with each other so as to the central axis of the wheel bodies are made coincident with each other and, wherein the rollers squeeze the connecting members so as to be 90 out of phase in the rotation direction of the wheel body with one another from the first suction pump to the second suction pump;

wherein the outlets of the plural suction pumps are lead to different waste-ink tanks each comprising a means for counting the amount of ink flowing into the waste-ink tanks and an indicating means and a deactivating means;

wherein the counting means counts accumulately the amount of ink by selectively use of parameters specified according to respective ink suction operations modes;

wherein means for indicating indicates whether the amount of ink counted by the counting means reaches a predetermined value; and wherein the means for deactivating deactivates the apparatus when the amount of ink counted by the counting means reaches for a predetermined value.

72. An ink jet recording apparatus:

a plurality of recording heads each having a face on which a plurality of nozzle orifices are formed, the recording heads mounted on a carriage to be moved reciprocatively in the widthwise direction of a recording sheet;

a capping device disposed in a non-print region of the recording head, the capping device including a plurality of cap units each for sealing the nozzle-formed surface of the associated recording head in cooperation with the movement of carriage; and a plurality of suction pumps each for applying negative pressure in the interior space of the associated cap unit via connecting members while the associated cap unit seals the associated nozzle-formed surface in cooperation with at least one drive source;

wherein outlets of plural suction pumps are lead to different waste tanks wherein the waste tanks have a counting mechanism to count the amount of ink flowing into the waste tanks and a deactivation mechanism for deactivating the apparatus when the amount of ink counted by the counting mechanism reached a certain value.

* * * * *